US011021222B2

(12) United States Patent
Sheard

(10) Patent No.: US 11,021,222 B2
(45) **Date of Patent: *Jun. 1, 2021**

(54) UNDERWATER WATERCRAFT

(71) Applicant: Ian Sheard, Upland, CA (US)

(72) Inventor: Ian Sheard, Upland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/009,112

(22) Filed: Jun. 14, 2018

(65) Prior Publication Data

US 2018/0290718 A1 Oct. 11, 2018

Related U.S. Application Data

(63) Continuation of application No. 15/021,931, filed as application No. PCT/US2014/053903 on Sep. 3, 2014, now Pat. No. 10,000,264.

(60) Provisional application No. 61/937,230, filed on Feb. 7, 2014, provisional application No. 61/877,282, filed on Sep. 12, 2013.

(51) Int. Cl.

| | |
|---|---|
| ***B63G 8/22*** | (2006.01) |
| ***B63G 8/00*** | (2006.01) |
| ***B63G 8/04*** | (2006.01) |
| ***B63G 8/38*** | (2006.01) |
| *B63H 5/125* | (2006.01) |

(52) U.S. Cl.

CPC ..... *B63G 8/22* (2013.01); *B63G 8/001* (2013.01); *B63G 8/04* (2013.01); *B63G 8/38* (2013.01); *B63B 2211/02* (2013.01); *B63H 2005/1258* (2013.01)

(58) Field of Classification Search

CPC . B63G 8/00; B63G 8/001; B63G 8/04; B63G 8/14; B63G 8/16; B63G 8/18; B63G 8/22; B63G 8/38; B63H 5/125; B63C 11/00; B63C 11/46

USPC ..... 114/331

See application file for complete search history.

(56) References Cited

U.S. PATENT DOCUMENTS

| | | | |
|---|---|---|---|
| 2,859,721 | A | 11/1958 | We |
| 3,364,895 | A | 1/1968 | Jong et al. |
| 4,938,164 | A | 7/1990 | Onofri |
| 5,237,952 | A | 8/1993 | Rowe |
| 5,704,309 | A | 1/1998 | Kohnen |
| 6,058,848 | A | 5/2000 | Futami et al. |

(Continued)

OTHER PUBLICATIONS

Written Opinion and International Search Report received in PCT/US14/53903 dated Dec. 9, 2014; pp. 7.

*Primary Examiner* — Lars A Olson

(74) *Attorney, Agent, or Firm* — Brook Law Group, P.C.

(57) ABSTRACT

An underwater watercraft including a passenger compartment and an ingress/egress port in which the watercraft has buoyancy and center of gravity adjusted to maintain a generally level or other desired attitude when submerged, and an optionally angled attitude at a water surface for ingress/egress. The attitude is also adjustable via the placement of ballast and optionally including a movable ballast that adjusts the location of the center of gravity as desired. The ingress-egress port optionally includes an entry elevated from a main passenger compartment and including a riser and optionally removable or concealable handrails. The ingress-egress port has an angled orientation in a submerged mode, and an optional orientation generally parallel to the water surface or angled but above the surface in a surface mode.

20 Claims, 28 Drawing Sheets

(56) References Cited

U.S. PATENT DOCUMENTS

| | | | | |
|---|---|---|---|---|
| 6,321,676 | B1 | 11/2001 | Kohnen et al. | |
| 6,371,041 | B1 | 4/2002 | Ness | |
| 7,131,389 | B1 | 11/2006 | Hawkes | |
| 7,255,054 | B1 | 8/2007 | DiGregorio | |
| 10,000,264 | B2 * | 6/2018 | Sheard | B63G 8/001 |
| 2002/0195040 | A1 | 12/2002 | Mucke | |
| 2014/0090590 | A1 | 4/2014 | Maurer | |

* cited by examiner

SECTION A-A

UNDERWATER WATERCRAFT

This application is a continuation of, has priority to and claims benefit from all of U.S. Provisional Application No. 61/877,282, filed Sep. 12, 2013 and titled "Underwater Watercraft", U.S. Provisional Application No. 61/937,230, filed on Feb. 7, 2014 and titled "Underwater Watercraft", PCT No. PCT/US2014/053903, filed on Sep. 3, 2014 and titled "Underwater Watercraft", U.S. patent application Ser. No. 15/021,931 that was filed on Mar. 14, 2016 and titled "Underwater Watercraft" and U.S. Pat. No. 10,000,264, which issued on it on Jun. 19, 2018, all of which are referred to and incorporated herein in their entireties.

FIELD OF THE DISCLOSURE

The disclosure that follows relates to a high visibility underwater watercraft for scientific and recreational touring.

BACKGROUND

Various forms of underwater watercraft for recreational, exploratory and scientific use are known. Various arrangements of the known craft are known relating to providing a rider compartment and ingress/egress opening. Examples of such underwater craft are provided in U.S. Pat. Nos. 4,938,164, 5,704,309 and 6,321,676.

Some known underwater craft have a passenger compartment including a transparent sphere, in which a portion of the sphere is hinged, enabling ingress and egress. In such an arrangement, a ring seal may be provided, providing a fluid blocking seal between the exterior and interior of the compartment. Such a seal although low profile, can block a portion of the field of view from the interior of the compartment. For example, in one such arrangement, the ring seal is positioned approximately at an equatorial location on the compartment sphere. In another arrangement, such as in the Remora 2000 underwater watercraft from Comex, and the Triton 1000/3 craft from Triton LLC, a hatch is provided at a top end of the passenger compartment, blocking an upward portion of the field of view.

In another arrangement, such as in the Alicia craft, a spherical passenger compartment is provided, with the hatch positioned behind the spherical portion of the compartment. Such an arrangement avoids a view blocking seal, but also increases the size of the vehicle in a portion behind the seal in order to position the hatch.

It often is desired to load or unload passengers from an underwater craft while the craft is floating at the water surface, and to have the hatch above the surface so water does not flow into the interior while the hatch is open—as opposed to lifting the vehicle out of the water, such as using a crane. Various known craft, including those described above, retain a similar attitude on the surface as they do underwater, i.e. horizontal. In such known craft, ballast tanks are filled with air via pressurized tanks, to increase their buoyancy and retain the vehicle on the surface. In one such large watercraft, the Atlantis, the ballast tanks are positioned above the pressure hull where the occupants sit, affording stability.

Known single sphere submersibles have their center of gravity and center of buoyancy aligned along a vertical centerline of the sphere, aligning a hatch or ingress/egress opening with them. For surfacing where access is through a top hatch, to ensure that the submersible is in the similar horizontal attitude at surface as it is under water, the surface buoyancy would be spaced generally evenly in front and behind of the spherical cabin, for example in pontoons along either side, and usually at or below the horizontal centerline of the sphere. Likewise, heavy items, such as battery pods, are usually similarly equally placed in front of and behind the vertical centerline of the sphere. Positioning of the hatch or ingress/egress apparatus on or vertically above the passenger cabin has a disadvantage or reducing the field of view from the passenger cabin.

Accordingly, there is a need for an underwater craft having a wide or generally unobstructed forward, sideways and upwards field of view, providing an ingress and egress hatch to the exterior that is positioned out of the field off view, and also provides surface stability for ingress and egress, in addition to a reduced footprint enabling storage on smaller vessels and transport on smaller trailers.

SUMMARY

The present disclosure, in its many embodiments, alleviates to a great extent the disadvantages of known underwater watercraft by providing a generally spherical and transparent passenger compartment with an ingress/egress hatch positioned in a mounting frame to the rear of the passenger compartment, or to a generally spherical passenger compartment.

In one embodiment, a passenger compartment includes a clear portion affording the occupants a view of the outside, and attached to it, a pressure hull or pressure vessel providing an ingress/egress port. In one embodiment, the clear portion of the passenger compartment is made of a portion of a sphere, made of an acrylic or other largely transparent material. Of course any shape can be used that affords a view of the exterior. Attached to the clear portion is the optional access pressure vessel, via a fluid-tight seal or connection. The access pressure vessel includes a port or access hatch providing an entry or exit for the occupants.

In an embodiment the watercraft has an angled surface mode and horizontal submerged mode, buoyancy elements such as ballast are applied to effectuate surfacing, such as by evacuating water from ballast elements, thereby increasing buoyancy. The ballast elements are positioned such that in a buoyant state (i.e. water evacuated), the center of buoyancy is moved towards the rear of the watercraft as buoyancy is increased. In such an embodiment, the center buoyant force applied by the ballast is posterior to the location of the center of gravity. When in water, the center of gravity will maintain at a point at or vertically below the center of buoyancy (generally in line with the direction of the Earth's gravitational force), and since the center of gravity remains generally fixed, the attitude of the watercraft changes depending upon the center of buoyancy. As the center of buoyancy moves to the rear the attitude of the watercraft also changes, assuming a tail angled up attitude, generally maintaining the center of buoyancy vertically above the center of gravity. For example, when at the surface, or at some instances of surfacing, the center of buoyancy is positioned posterior to its location in an operation mode under the surface. At the water surface, when the watercraft is in position for ingress or egress, the opening of the hatch extends above the surface. In such a position, water inflow is reduced or eliminated. In an example, the opening defines a circle or other shape in a plane generally parallel to the surface, with buoyancy elements maintaining the watercraft in a position such that the opening is above the surface. In such an embodiment, when the watercraft is submerged, the plane of the opening of the hatch is at an angle with respect to the water surface.

The buoyancy elements can be any type of buoyant material or structure that maintains the watercraft at the surface when desired. In an example, longitudinally extending pontoons or ballast tanks are provided, along with optional trim ballast tanks and optional trim weight(s). If a construction is selected in which the tanks are maintained in a plane generally parallel to the surface, the access hatch opening can be selected to be in the same orientation. In an embodiment in which the watercraft assumes a tail elevated attitude at the surface, the access hatch opening can be selected to be generally parallel to the surface and at an angle with respect to the buoyancy elements or with respect to the horizontal plane when the vehicle is in an operation mode. In an embodiment, the center of gravity and buoyancy elements are positioned such that the buoyancy elements and/or passenger seats are generally horizontal (i.e. perpendicular to the direction of the Earth's gravitational pull) or generally parallel to the surface such as in general operation of the watercraft under the surface, and the passenger seats and buoyancy elements are at an acute angle other than parallel to the surface (or perpendicular to the direction of gravity) when at the surface, and the opening of the access hatch is generally parallel to the surface. The attitude of the watercraft may be adjusted by any combination of weights, or buoyancy elements, or other arrangement of components of the watercraft.

In an alternative embodiment, a generally tail elevated attitude in a surface or surfacing mode is achieved by moving the center of gravity (and center of buoyancy) of the vehicle, such as by application of a movable trim weight, or alternatively or additionally using trim ballast tanks. In one embodiment with a movable trim weight, the trim weight is movably mounted to the watercraft, such as in a position beneath elements of the watercraft, such that the weight can be moved forward and backwards in the craft. As the trim weight is moved from front towards rear, the center of gravity of the watercraft also moves from front towards rear. In a tail elevated mode, the trim weight is positioned more towards the front of the watercraft than in a horizontal operation mode. The trim weight may be composed of heavy components of the vehicle, for example the batteries and/or battery pods, mounted on a movable rack or other assembly to move the components.

In an alternative embodiment, trim ballast tanks may be used to adjust the attitude of the watercraft. For example, front and rear trim ballast tanks are provided and are evacuated using air to achieve a desired level of buoyancy and attitude angle. Likewise, a combination of trim ballast tanks and movable trim weight(s) may be used to determine a desired vehicle attitude.

In an embodiment where the watercraft assumes the generally tail elevated or angled attitude in a surface mode, the buoyancy ballast elements can be positioned anterior to the main passenger compartment corresponding to the partial sphere, although any other positioning of the weight of different vehicle elements and/or ballast may be selected in alternative embodiments.

In an alternate embodiment a passenger compartment is formed with a generally spherical and clear enclosure, although any shape can be used that affords a view of the exterior, and all or a portion of the enclosure may be clear. The compartment has an ingress/egress port or access hatch positioned to the rear of seats, or in such a way that it is out of the normal field of view of occupants positioned on the seats. Optionally a riser is either fixedly or removably attached around the hatch via a fluid tight seal or connection, elevating the effective ingress/egress elevation of the hatch opening above the water surface.

Accordingly, it is seen that a reduced footprint underwater watercraft is provided, with improved visibility from a passenger compartment, and an optional tail angled up orientation in a surface or surfacing mode of operation, in which the angle of a hatch opening is set depending upon the expected angle in the surfacing mode.

Other objects and advantages of the present invention will become more evident hereinafter in the specification and drawings that follow.

BRIEF DESCRIPTION OF THE DRAWINGS

The foregoing and other objects of the disclosure will be apparent upon consideration of the following detailed description, taken in conjunction with the accompanying drawings, in which.

DETAILED DESCRIPTION

In the following paragraphs, embodiments will be described in detail by way of example with reference to the accompanying drawings, which are not drawn to scale, and the illustrated components are not necessarily drawn proportionately to one another. Throughout this description, the embodiments and examples shown should be considered as exemplars, rather than as limitations of the present disclosure. As used herein, the "present disclosure" or "present invention" refer to any one of the embodiments described herein, and any equivalents. Furthermore, reference to various aspects of the invention throughout this document does not mean that all claimed embodiments or methods must include the referenced aspects or features.

Figure 1:
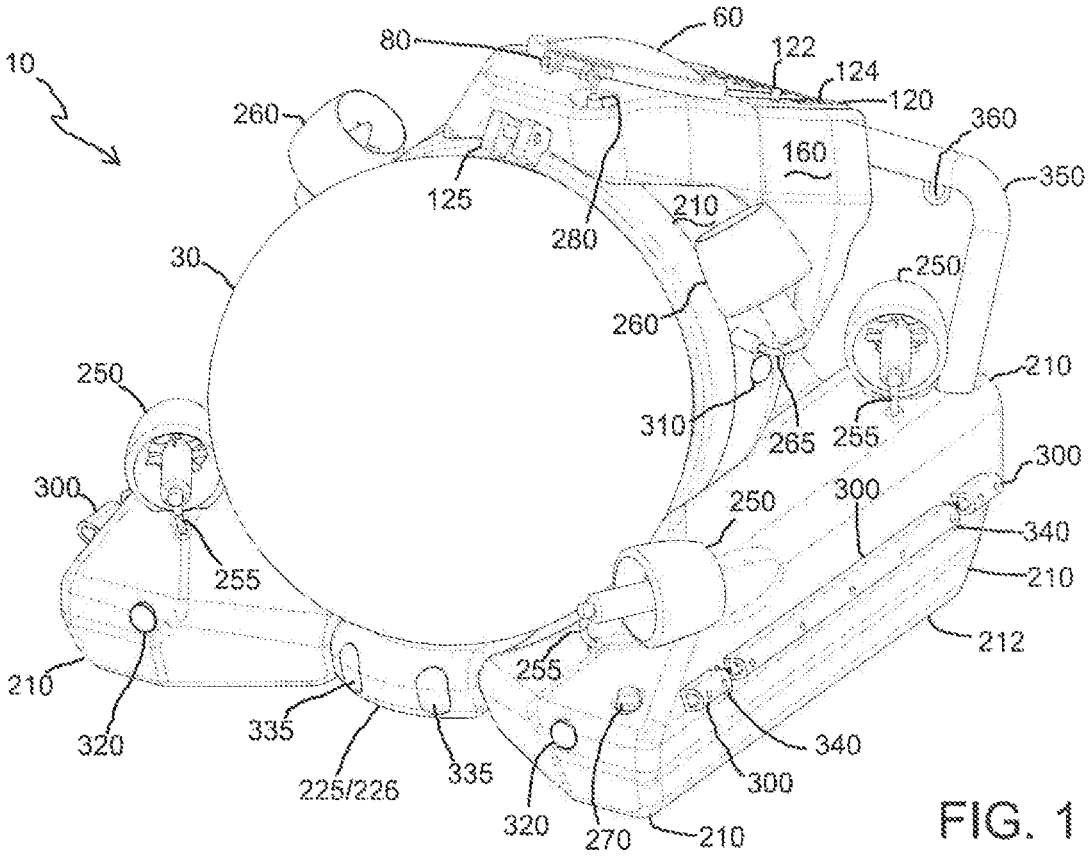
FIG. 1 is a front perspective view of an underwater watercraft in accordance with the present invention.
Figure 2:
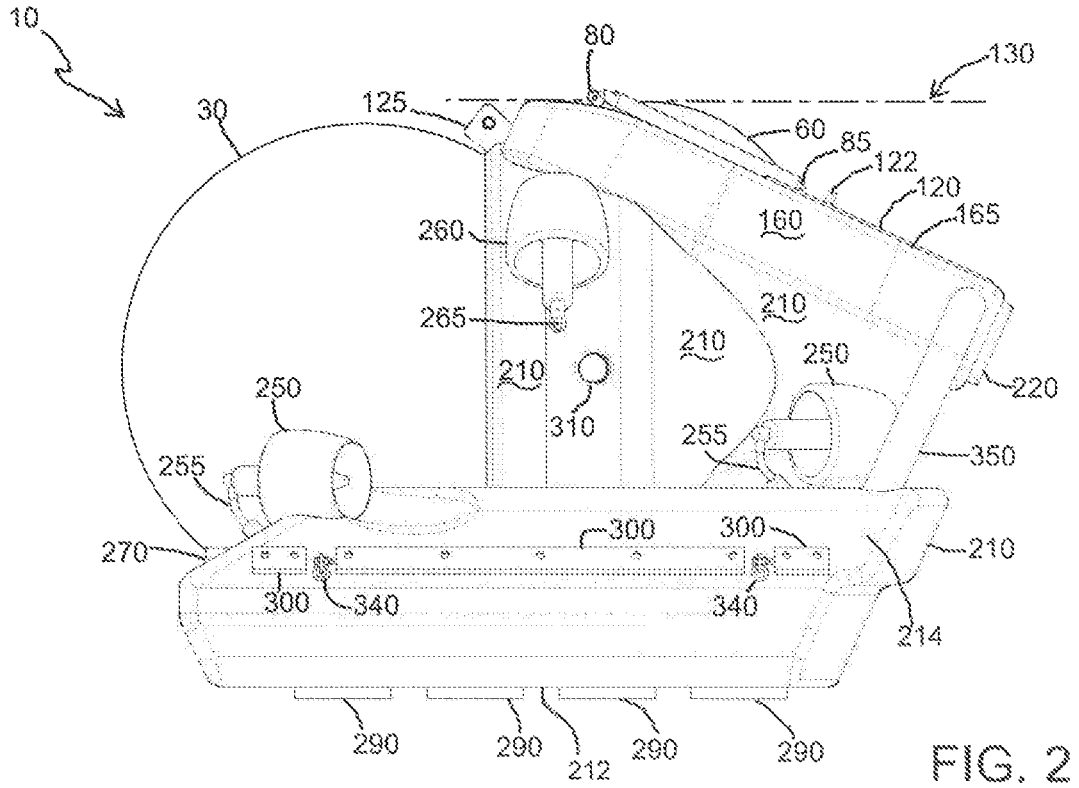
FIG. 2 is a port side plan view of an underwater watercraft in accordance with the present invention.
Figure 3:
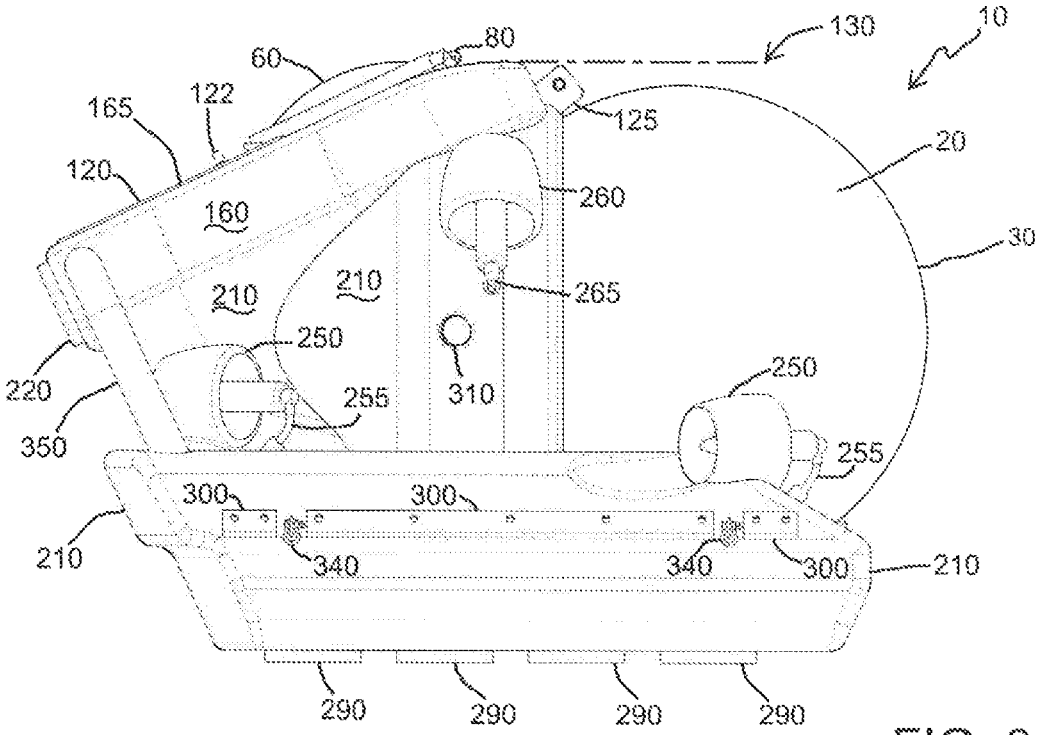
FIG. 3 is a starboard side plan view of an underwater watercraft in accordance with the present invention.
Figure 4:
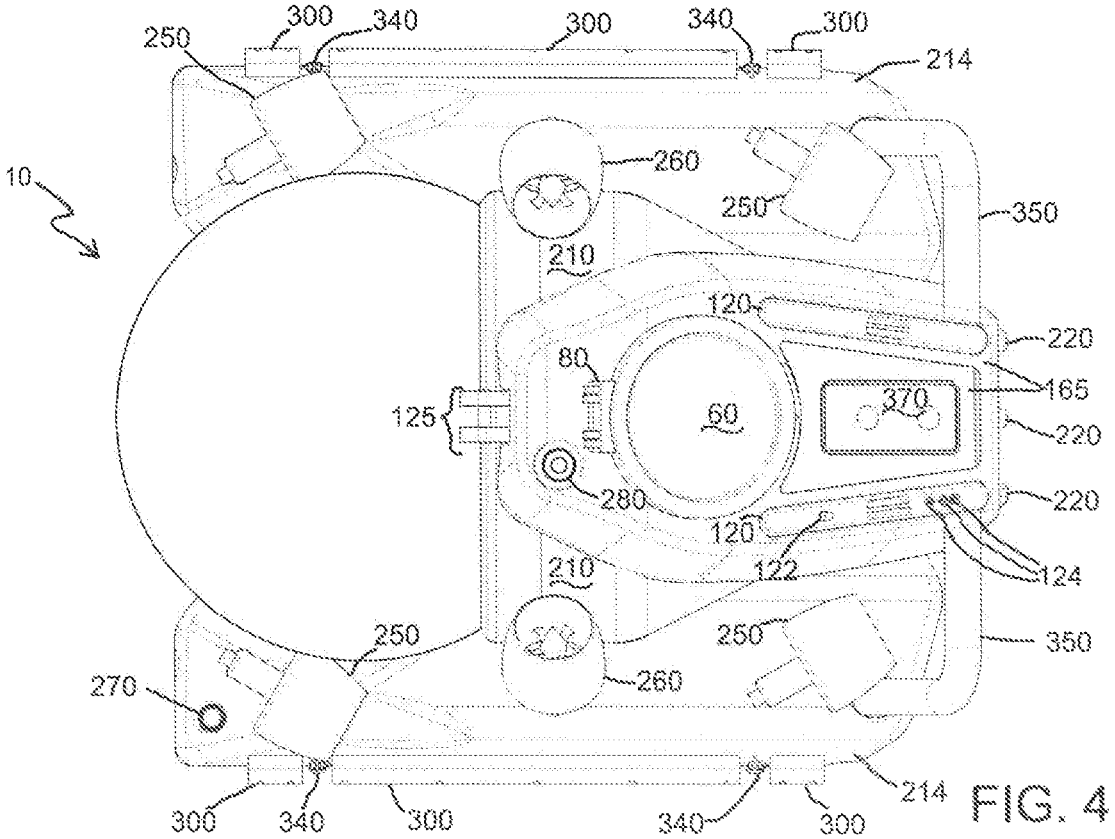
FIG. 4 is a top plan view of an underwater watercraft in accordance with the present invention.
Figure 5:
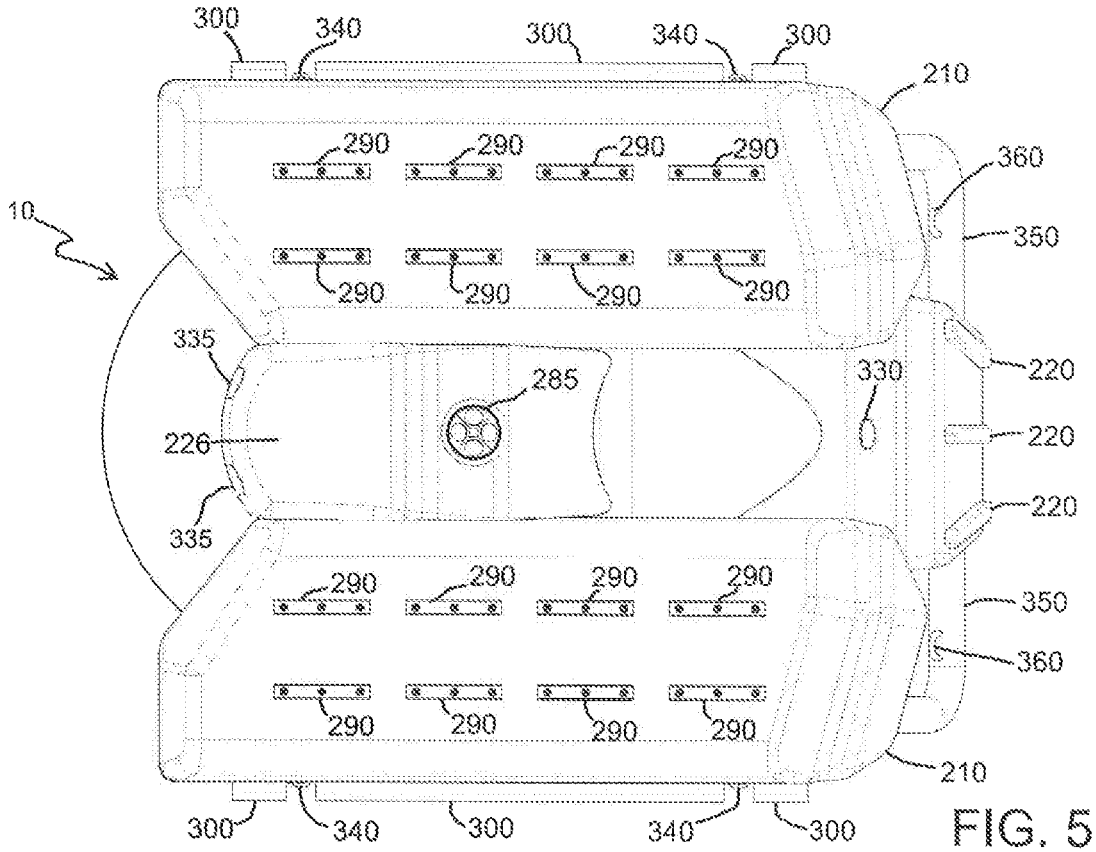
FIG. 5 is a bottom plan view of an underwater watercraft in accordance with the present invention.
Figure 6:
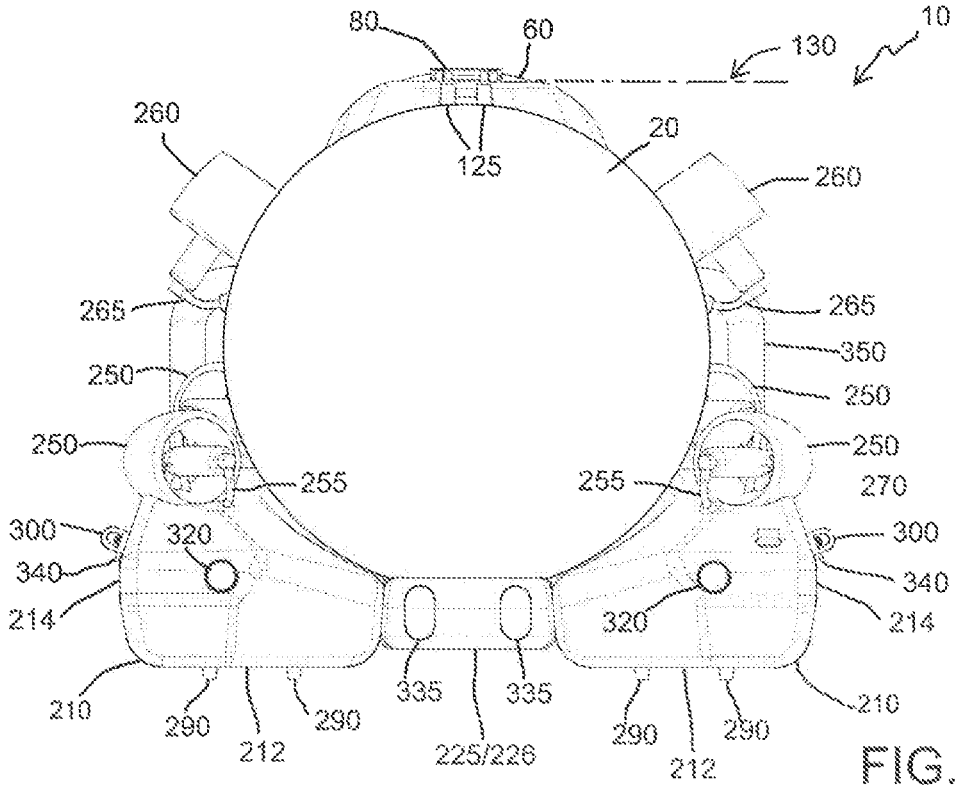
FIG. 6 is a front plan view of an underwater watercraft in accordance with the present invention.
Figure 7:
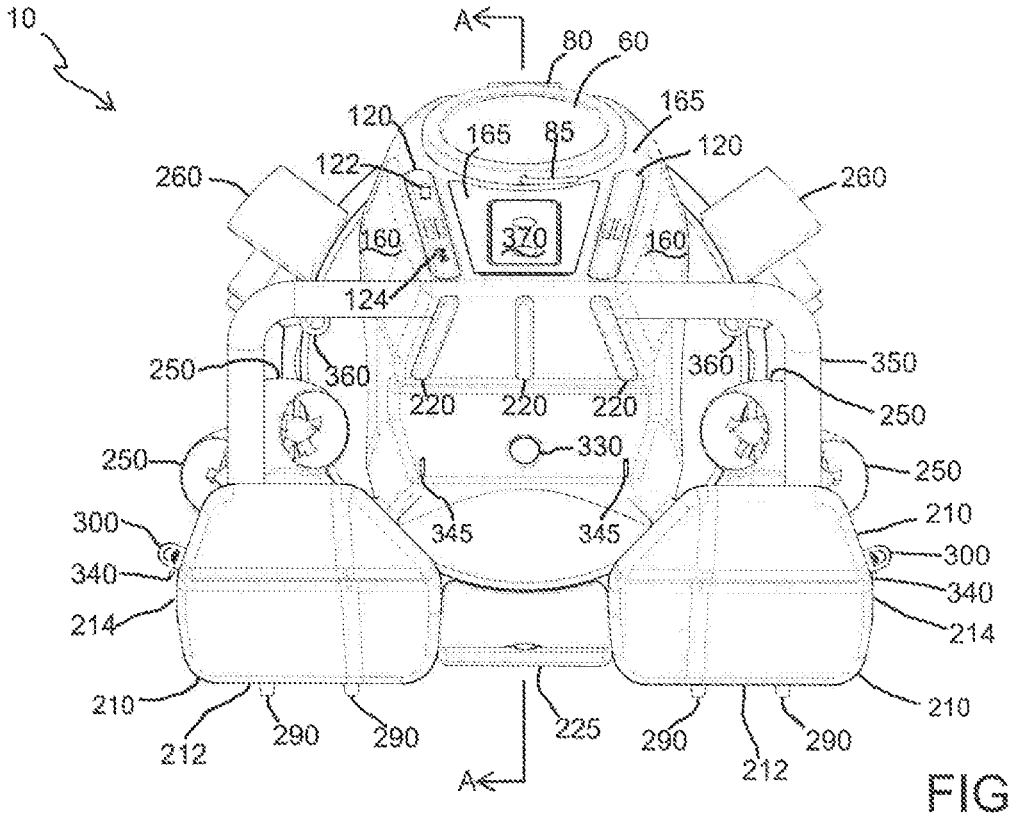
FIG. 7 is a rear plan view of an underwater watercraft in accordance with the present invention.
Figure 9:
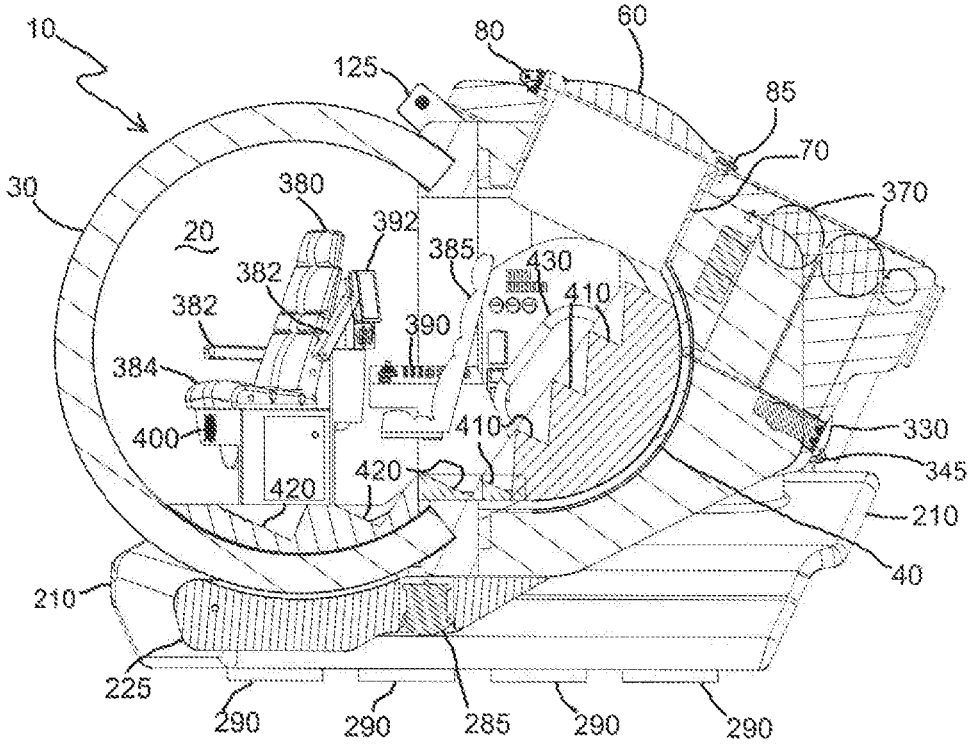
FIG. 9 is a cross-sectional port side view of a portion of an underwater watercraft in accordance with the present invention taken along A-A of FIG. 7.
Figure 10:
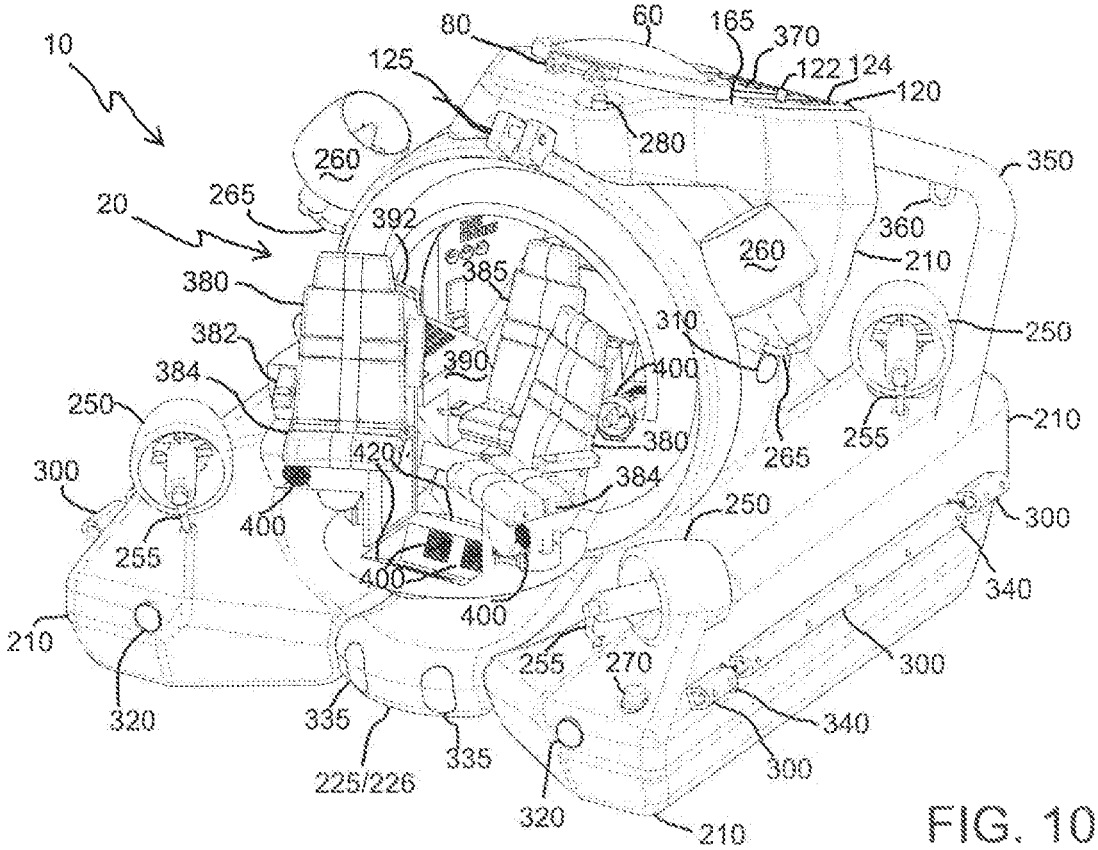
FIG. 10 is a front perspective view of a portion of an underwater watercraft and the interior of the passenger compartment in accordance with the present invention.
Figure 11:
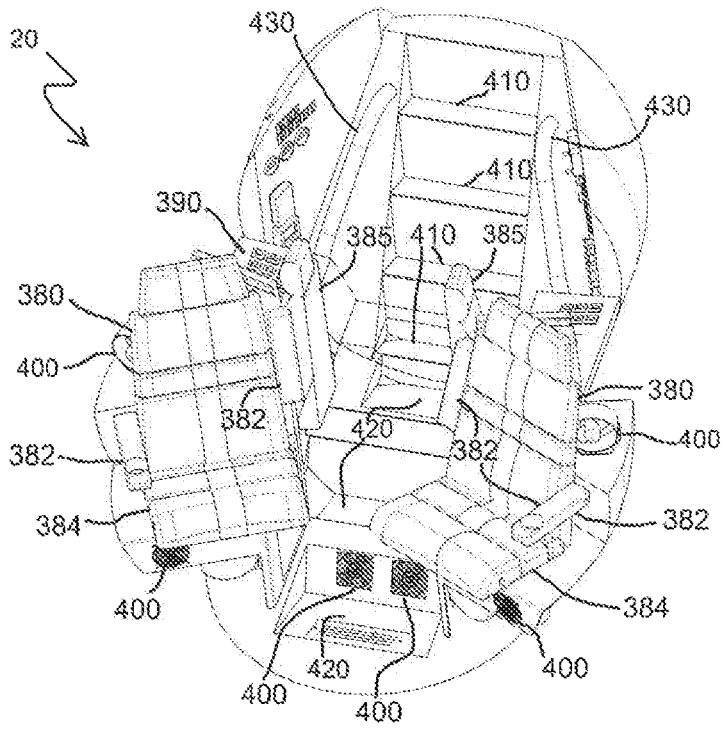
FIG. 11 is a perspective view of a passenger compartment in accordance with the present invention.
Figure 12:
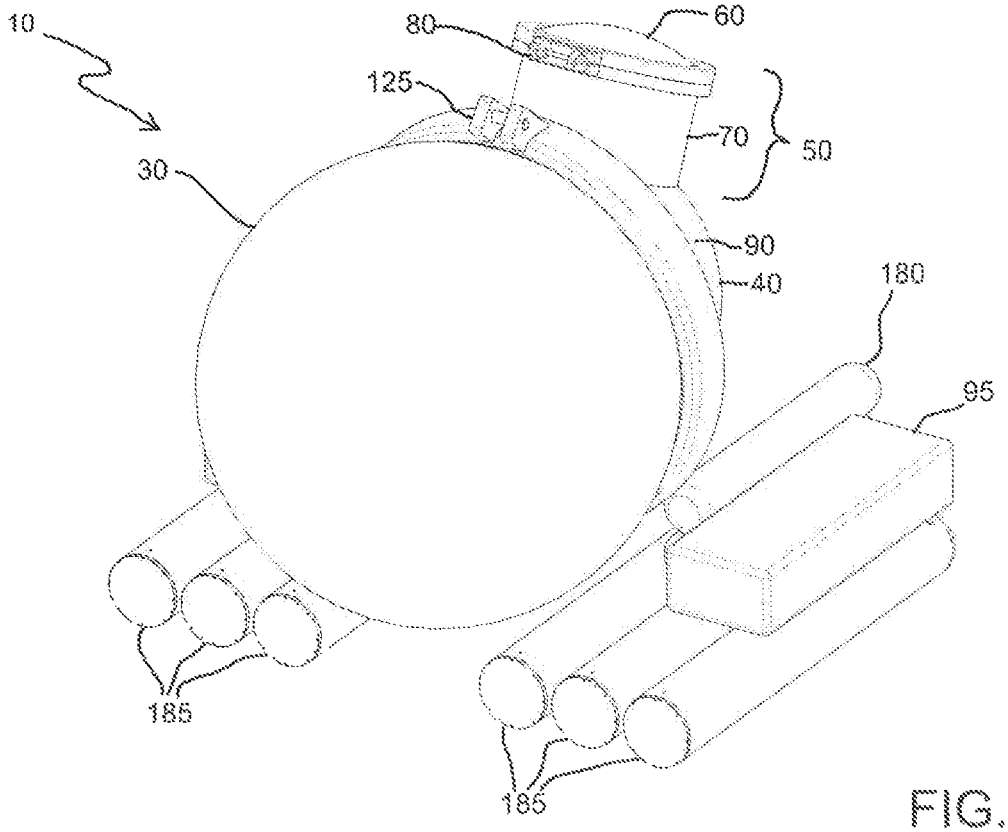
FIG. 12 is a front perspective view of components of an embodiment of an underwater watercraft in accordance with the present invention.

FIG. 1 provides a perspective view of an embodiment of an underwater watercraft 10 in accordance with the present invention. Any shape or size of watercraft may be selected, and the figures illustrate one such embodiment. The components of the watercraft are now described. A passenger compartment 20 (the interior of which is shown in FIGS. 9 and 10, for example) is provided, such as partially enclosed within partial sphere 30. Partial sphere 30 is constructed of a transparent acrylic material although any material providing a desired structural strength sufficient to withstand submerged environmental pressures and maintain a fluid sealed environment may be used. Although a spherical shape is illustrated for this embodiment, it is noted that any shape for the viewing area or passenger compartment 20 may be provided.

Access portion 40 is provided posterior to the partial sphere 30, and a fluid or water tight seal between the two is formed. The access portion 40 is alternatively referred to as an access pressure vessel 40 in this description. An ingress/egress port 50 (for example as labeled in FIG. 8) is formed towards an upper portion of the access pressure vessel 40. The port 50 includes an access hatch 60 positioned on a riser 70, and linked thereto, such as using a hinge 80. Of course it is understood that the hatch 60 may be positioned at any location such that in the surface state of the watercraft 10, the hatch and/or riser 70 opening is above the waterline 200. One or more optional latch handle 85 can be provided as well to assist with opening the hatch 60 from the exterior of the watercraft 10. The riser can provide any desired length of separation between a lower portion of the access pressure vessel 40 and the hatch 60. In one example, a relatively long riser 70 is used to obtain a greater elevation of the hatch 60 when at the surface, reducing the amount of surface ballast required. Likewise, the use of the pressure vessel 40 with riser 70 enables for the hatch 60 to be moved away from the top of the sphere 30, and also from the portion of the passenger compartment 20 formed within the pressure vessel 40. For example in the illustrated embodiments, a portion of the passenger compartment is formed within a rear portion 90 of the pressure vessel 40. Although an access pressure vessel 40 is provided in the illustrated embodiments, it should be understood that it is an optional feature, and the ingress/egress port(s) of the vehicle 10 may be provided on any other portion providing access to the interior.

In the illustrated example, the access pressure vessel 40 is constructed of a metallic material, although any desired material can be selected. The rear portion 90 includes a half sphere, but also can be of any desired shape. The half sphere of the rear portion 90 is smaller in diameter than the passenger compartment sphere 30, which has an advantage of requiring smaller lower ballast tanks 95 as compared to a construction in which the rear portion 90 is larger than partial sphere 30.

Figure 13:
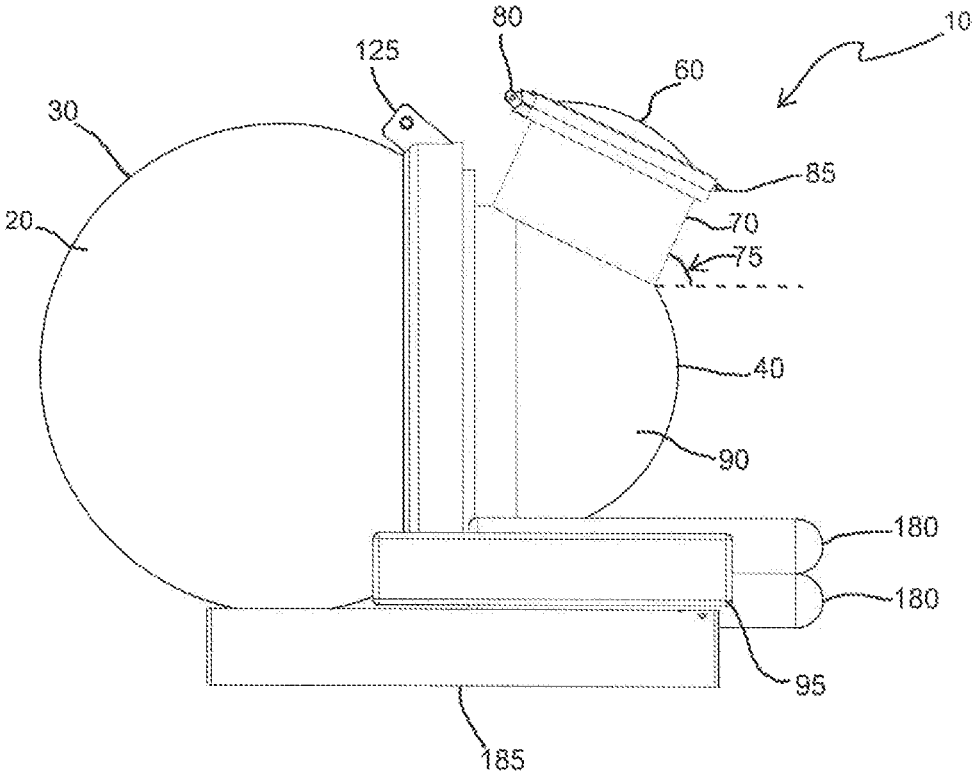
FIG. 13 is a side view of the components of an underwater watercraft of FIG. 12.
Figure 14:
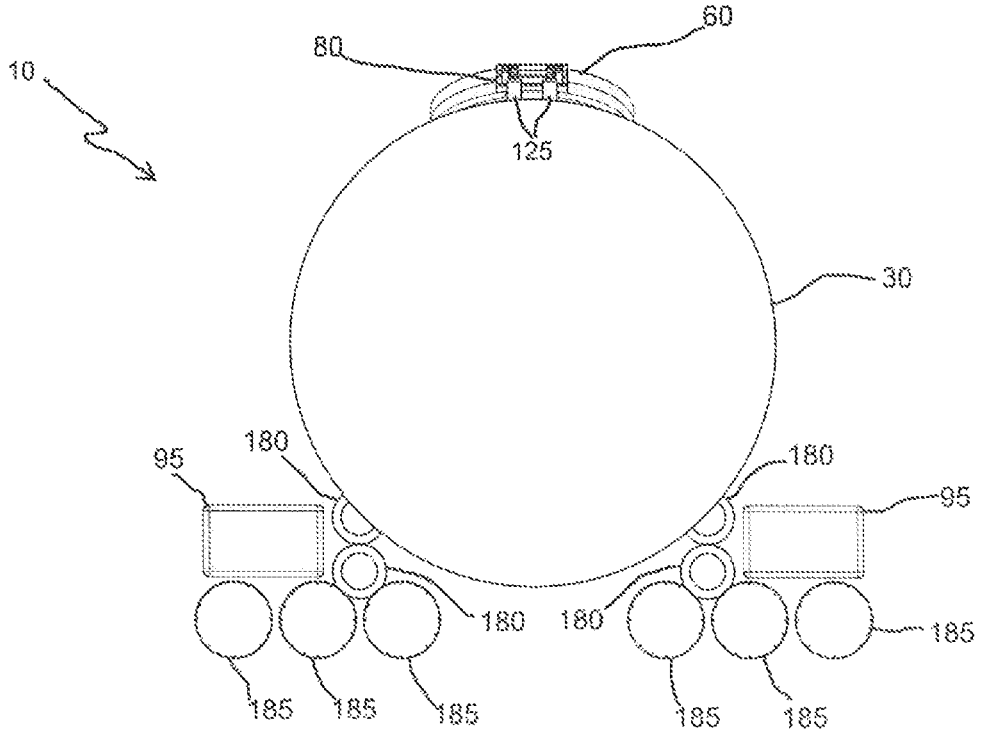
FIG. 14 is a front view of the components of an underwater watercraft of FIG. 12.
Figure 15:
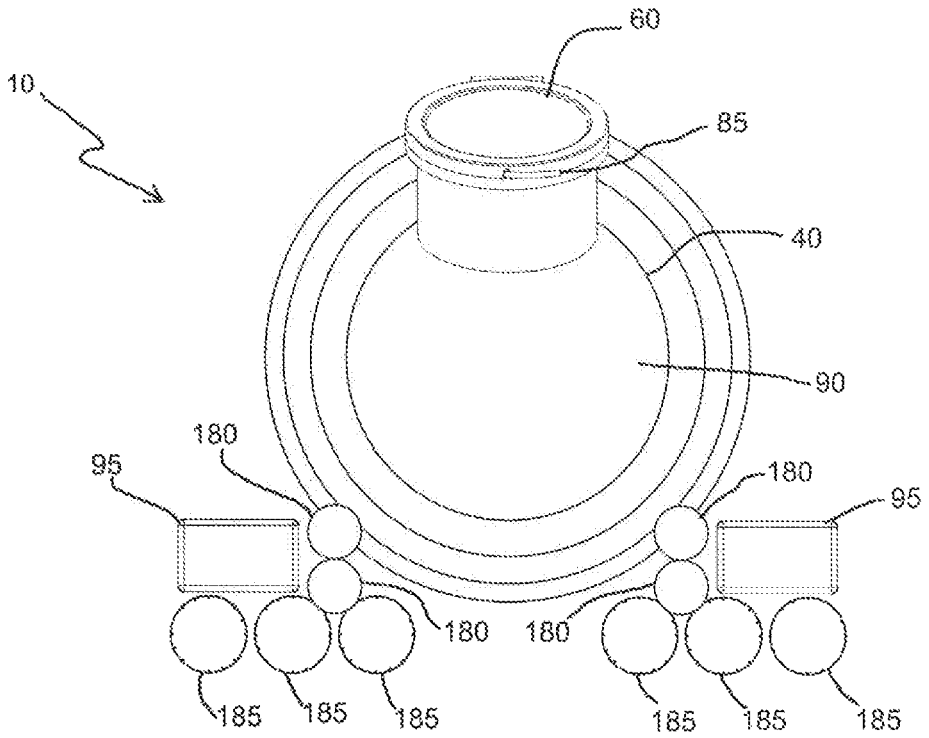
FIG. 15 is a rear view of the components of an underwater watercraft of FIG. 12.
Figure 16:
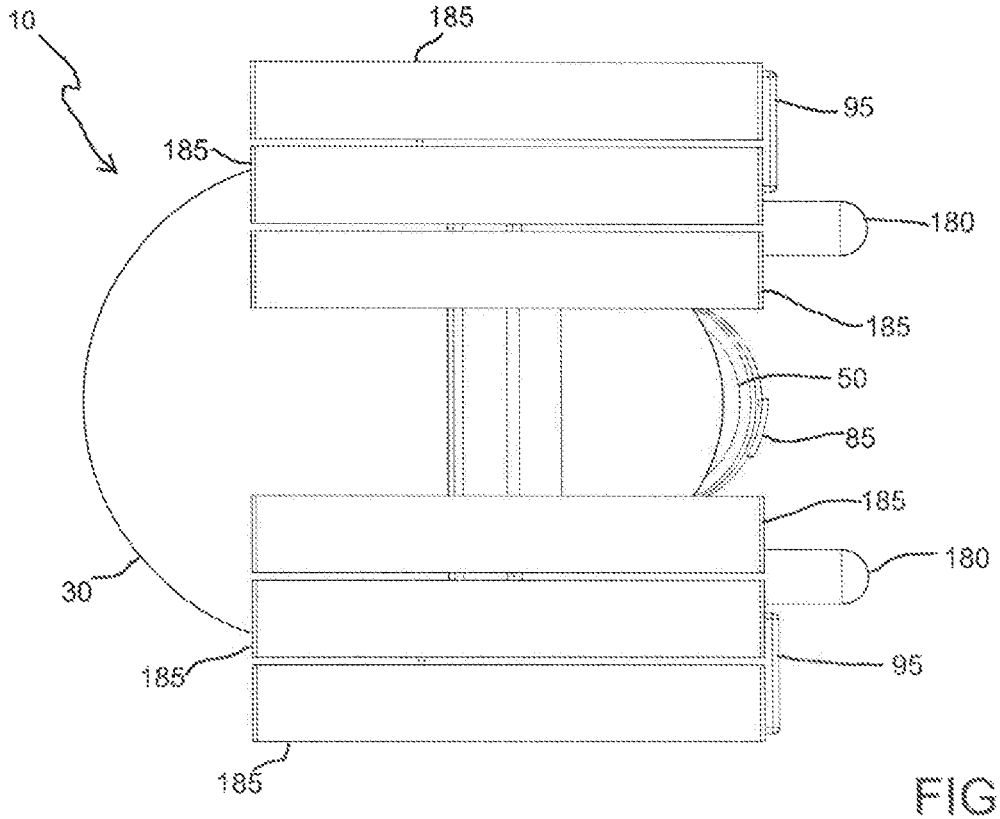
FIG. 16 is a bottom view of the components of an underwater watercraft of FIG. 12.
Figure 17:
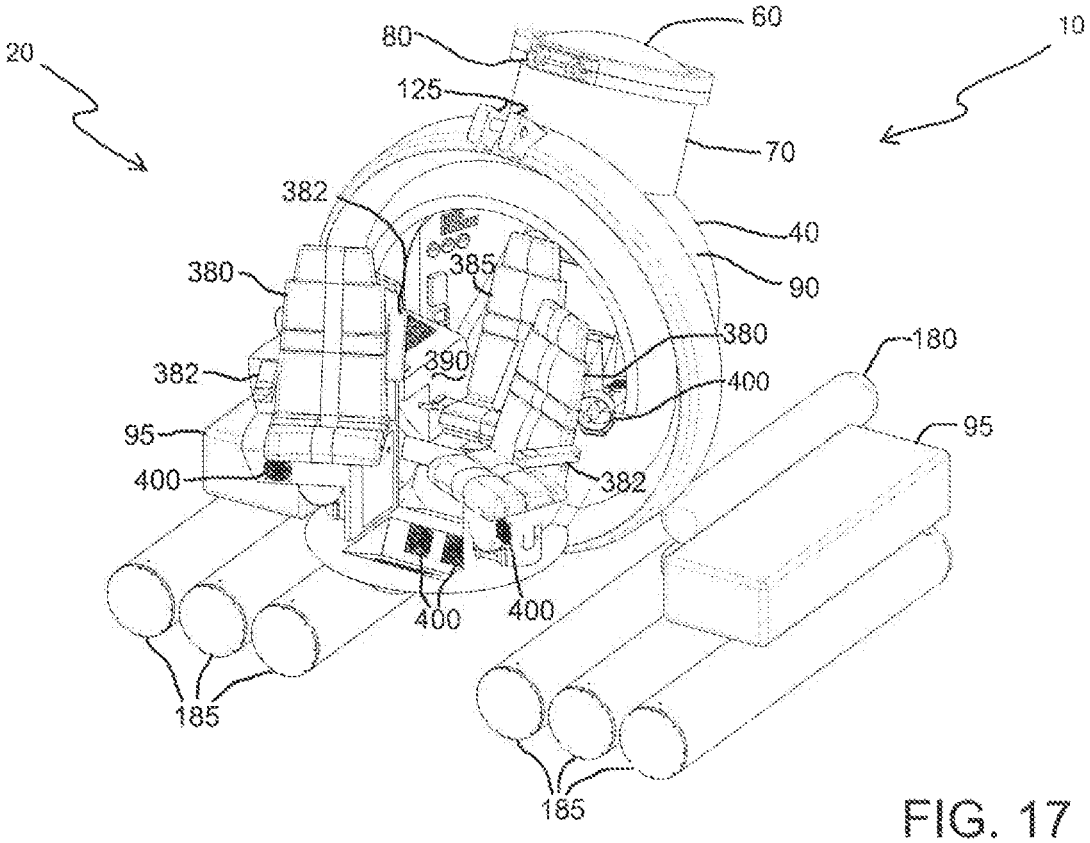
FIG. 17 is a front perspective view of components of the underwater watercraft in accordance with the present invention.

The opening 65 defined by the access hatch 60 is positioned on the rear portion 90 in the illustrated example at an angle relative to the plane of the water surface 200 when submerging or submerged. In the illustrated example, the riser 70 is cylindrical, defining a circular opening 65. However, any desired shape for riser 70 and opening 65 may be selected. Generally speaking, the longer the riser 70, the less surface ballast is required, but the higher the overall height of the watercraft 10 is in storage. By putting riser 70 at an angle 75 (illustrated in FIG. 13, for example), its length can be maximized while still retaining a lower overall height for the submersible when in storage or on the deck of a support ship. Although the optional riser 70 at an angle provides improved freeboard access at surface, it is understood that the access opening 60 may be positioned without a riser.

In an example, the riser 70 is positioned to extend to a height that is at, or close to a plane at the top of the watercraft 10. An example of the plane location is provided with reference number 130. This design feature can further reduce the height profile of the vehicle 10 in that the protrusion hatch 60 above the body of the watercraft 10 can be reduced or eliminated depending up on a design selected.

Figure 20:
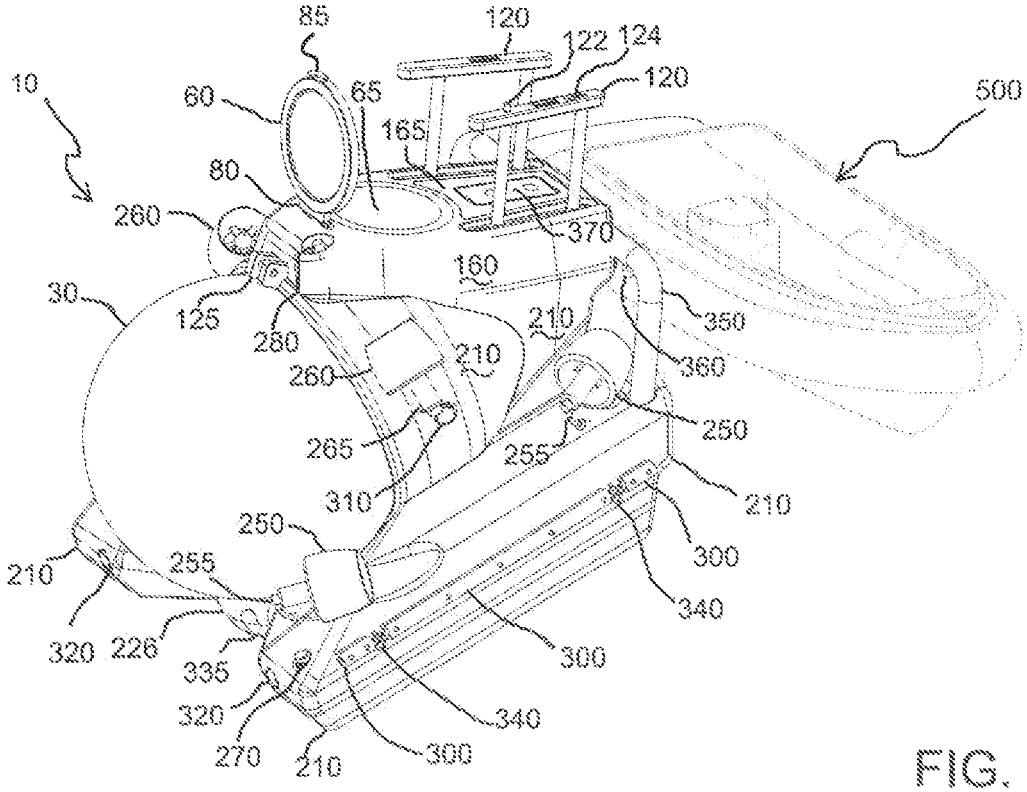
FIG. 20 is a perspective view of an underwater watercraft in accordance with the present invention situated at a water surface with an example of a tender craft.

In operation, the hatch 60 may open to a side and lock in place serving as a hand rail for passengers entering or exiting the watercraft 10. In the illustrated embodiment, the hatch opens forward and out of the way and two optional retractable hand rails 120 are provided. An illustration of the handrails extended is provided in FIGS. 20 and 23. A handrail retraction/extension linkage optionally may be provided to link extension of the handrails 120 with opening of the hatch 60. Alternatively, an electronic control may be provided that triggers extension of the handrails 120 when the hatch 20 is opened and retraction on a closing actuation signal. In alternative embodiments, foldable, fixed or removable hand rails 120 are provided. The handrails 120 also can include optional strobe 122 and vehicle controls 124. These elements 122 and 124 also may be positioned at other locations on the craft 10.

The hatch assembly also optionally includes a skirt 140 positioned on an extendible riser 150. In operation, the opening of the hatch 60 allows for extension of the extendible riser 150. Alternatively, the riser 150 is fixed in place. In an alternate embodiment, a portion of the waterproof skirt 140 is connected around only a portion of the riser 150 and the remainder of is formed on the sealing surface 63 of the hatch 60. In another embodiment, the waterproof skirt 140 is formed entirely on the sealing surface 63 of the hatch. It should be understood that any seal that forms a fluid-tight seal can be used, and in some embodiments, neither a skirt 140 nor a riser 150 is used. An advantage of using an extendible riser 150 (or a fixed extended riser 150) is that in effect the hatch opening 65 is extended above the watercraft 10, which has advantages of reducing water entry, such as in rough weather.

Various arrangements of ballast tanks may be provided for promotion of dive level, and surface stability. In the illustrated embodiment, both lower ballast tanks 95 and optional upper ballast tanks 160 are provided. At the surface, the lower ballast tanks 95 (also referred to as pontoon tanks) may be selected to stay at a submerged or partially submerged position. The upper ballast tanks 160 optionally may have a flat upper surface 165 assisting with passenger access to the hatch 60. The upper ballast tanks 160 optionally as well may be submerged or partially submerged when the watercraft 10 is at the surface. Alternatively, as illustrated in FIGS. 50-53, the upper ballast 160 is open, like a boat interior, with the water either draining out or being pumped out at the surface, and when submerged it fills on its own. In this alternate embodiment, flat surface 165 is at the base of ballast 160 rather than at the top surface as in the closed embodiment. The use of upper and lower ballast tanks 95, 160 in combination serves to promote surface stability while also promoting downward visibility from the passenger compartment 20 by having the lower ballast tanks size reduced so as to be positioned out of or in a reduced portion of the field of view.

In the illustrated embodiments, the watercraft 10 has a generally angled surface mode and less angled, or generally horizontal submerged mode of operation. Examples of the angled surface mode are illustrated, in FIGS. 19-23. Examples of the less angled or horizontal mode of operation are illustrated in FIGS. 1-10 and 24. Depending upon the application of various ballast tanks (such as surface ballast 95, upper ballast 160 and trim ballast 96, 97) or trim weight(s) (illustrated within trim weight enclosures 98, 225; "trim weights" and "trim weight enclosures" will be referred to herein with reference numbers 98 and 225, collectively) or combinations of various ballast 95, 96, 97, 160 and trim weight(s) 98, 225 the angular orientation of the watercraft 10 is determined. In these examples, application of ballast and/or application of or movement of the trim weight(s) determines the attitude of the watercraft 10. Although these specific elements are referred to as trim weights in the illustrated embodiments, it should be understood that any element of the watercraft 10 may serve as a trim weighting element, such as any components of the vehicle having sufficient mass such as the batteries and/or battery pods, mounted on a moveable rack or other assembly to move the components.

In one example of a submerged mode, the watercraft 10 operates in the generally horizontal attitude. Ballast tanks 95, also referred to as pontoon surface ballast tanks 95, and optional upper ballast tank (s) 160 are completely filled with water and provide no additional buoyancy, except to the extent a buoyant material may be used for construction of the tanks, although a non-buoyant material also may be selected. In operation in a surfaced mode the pontoon surface ballast tanks 95 and optional upper ballast tank(s) 160 are partially or fully evacuated of water in order to rise towards or have stability at the surface 200 of the water. In one operational embodiment, when the watercraft 10 is at the surface, the evacuation of the ballast 95, 160 serves to provide a stable platform for embarking/disembarking.

When evacuated of water, the combined displacement of the trim ballast tanks (front 96 and rear 97) optionally may be selected to equal or approximate the maximum payload of the watercraft 10. If the maximum payload of personnel/equipment is loaded in operation, then the trim tanks 96, 97 can be fully evacuated of water (such as filled with air) to provide additional buoyancy to maintain the watercraft 10 at a desired surface buoyancy. For payloads in between the maximum and minimum, the ratio of air/water inside the trim tanks 96, 97 is adjusted to keep the watercraft 10 at the desired level of buoyancy. It may be desired to keep the watercraft 10 always positively buoyant and use the vertical thrusters 260 to move up and down, or adjust the buoyancy as desired, such as to provide negative buoyancy for descent and positive buoyancy for ascent.

By increasing the air to water ratio in the rear trim ballast tanks 97 and/or reducing the air to water ratio it in the front trim ballast tanks 96, the desired buoyancy can be maintained, but the attitude of the watercraft 10 can be altered, such as adopting a greater tail up attitude in a surface mode of operation. In the surface mode, the front and rear trim tanks 96, 97 will be predominantly evacuated of water, but may be adjusted to obtain the desired angle of the watercraft 10 for loading or unloading.

In one example, the rear trim ballast tank 97 is twice as far away from the center of gravity as the front trim ballast tank 96. In such an embodiment, it only requires to be half the size of the front trim ballast tank to have the same effect on the angle.

To reduce the size of trim ballast tanks 96, 97 in alternate embodiments, the payload can be made approximately constant on every dive by adding trim weights 99 (such as lead filled bags) in displacement trim weight enclosures 98. Although the displacement trim weight enclosures 98 are illustrated on riser 70, close to hatch 60, it should be appreciated that the enclosures can be positioned at any location on the watercraft 10 that can receive the weights 99. For example by way of illustration, if the maximum payload of the watercraft 10 is 700 lbs., and the occupants plus equipment weigh 600 lbs., then 100 lbs. of lead bags 99 may be mounted in enclosures 98 to achieve the maximum payload of 700 lbs. The trim ballast tanks 96, 97 then only need to be the required size to adjust the angle of the watercraft 10, such as for example to be around horizontal underwater, or perhaps nose down (or up) for descending, and nose up (or down) for ascending if desired. The trim ballast tanks 96, 97 would also be used to make slight changes in buoyancy of the vessel 10 to allow for ascent, descent or neutral buoyancy as desired.

The angle trim weight(s) 225 can be used in addition to, or as an alternative for trim tanks, such as the front and rear trim tanks 96, 97, and can be used for adjusting attitude of the watercraft 10. In this embodiment, the angle trim weight 225 is positioned within an optional trim weight enclosure 226. The trim weight 225 is movable, such as forward or backward, and the position desired can change the attitude. In one example the trim weight 225 is movable along a rotatable adjusting screw 227. Any desired control for rotating the adjusting screw 227 can be selected, such as electric, hydraulic and/or manual. Trim weight also optionally is mounted on guide rails 228. The trim weight assembly (including for example weight 225, screw 227 and rails 228) is illustrated in FIGS. 31-34 in a cutaway within the optional enclosure 226, for purposes of illustration only. It should be understood that although in one embodiment the enclosure 226 could have an opening, generally speaking it is most desired for the enclosure 226 to enclose the trim weight assembly components, although an optional door or hatch can be provided to provide interior access.

In an alternate embodiment, the trim weight enclosure 226 is movable along with the trim weight. In an embodiment in which the enclosure 226 is movable, and lights 335, or DVL 285 are mounted on it, then those components would move as well when the enclosure 226 is moved.

The trim ballast tanks 96, 97 can be used in such an embodiment to supplement the attitude adjustment, or alternatively solely to adjust the overall buoyancy of the vessel 10, or alternatively no trim ballast tanks 96, 97 are provided. Likewise, either or a combination of the angle trim weight 225 and/or trim ballast tanks 96, 97 can be used to maintain the watercraft 10 at the angle desired for hoisting, such as via grappling the craft 10 via the hoist point 125.

In one embodiment, the angled surface mode, the ballast 95, 96, 97 and/or trim weight(s) 98, 225 are regulated such that the watercraft 10 has a generally tail angled up attitude, and in submerged mode has a generally horizontal attitude. In an example of the horizontal mode, the center of gravity (CG) of the watercraft 10 is indicated by reference number 100 and the center of buoyancy (CB) is indicated with reference number 105, when operating in the generally horizontal mode. In this example, the center of buoyancy 105 is illustrated as being vertically above the center of gravity 100 and below the centerline 170, although in alternative embodiments the CB 105 and CG 100 may be at different locations. For example in another embodiment, the CB 105 is above the centerline. An imaginary line 107 between the CG 100 and CB (105 or 110) is in the direction of the Earth's gravitational pull, and in a horizontal mode, appears to be generally vertical.

Figure 8:
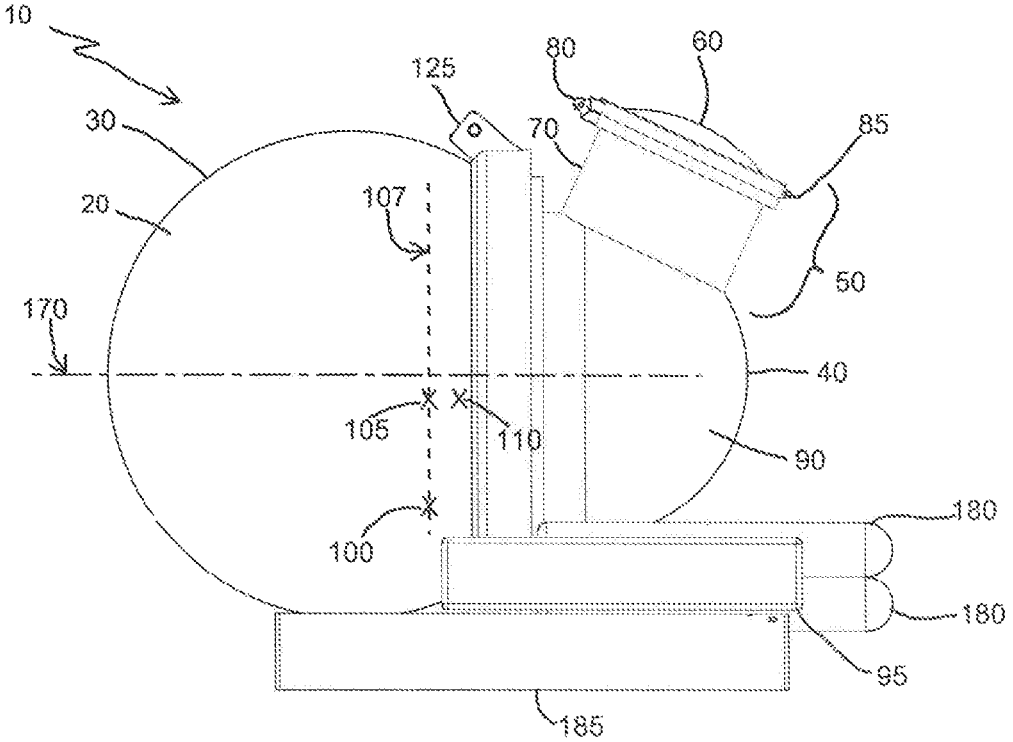
FIG. 8 is a port side view of a portion of an underwater watercraft in accordance with the present invention.

In the surface or tail angled up mode, the center of buoyancy (CB) shifts towards the rear of the watercraft 10. For illustration purposes such a location is indicated with reference number 110. For indication of the relative positions of the examples of the positions of CB 105 and 110 are indicated in FIG. 8. However, it should be understood that at any one time, the watercraft 10 has only a single center of buoyancy as understood in principals of physics. In the example illustrated in FIG. 8, the tail angled up mode center of buoyancy 110 is illustrated as being below the centerline 170, although in alternative embodiments the CB 110 and CG 100 may be at different locations. For example in another embodiment, the CB 110 is above the centerline. Depending upon an attitude angle desired, the center of buoyancy (CB) is shifted such as by applying ballast. For example, if a slight tail up attitude is desired, the CB is positioned slightly posterior to the CG. If a greater tail up attitude (greater angle) is desired, then the CB is adjusted to be positioned further to the rear of the CG. This motion towards the rear is effectuated by operation of the ballast tanks 95, 96, and/or 97 order to achieve a desired angle. In such an embodiment, the center of buoyant force resulting from evacuation of ballast tanks can be located as desired.

Positioning the CB in surface mode 110 to the rear of its position 105 where it is in submerged mode provides different advantages, such as, for example but not by way of limitation, improving forward or upward visibility out the clear structure 30, and allowing other components and ballast tanks to be positioned posterior to the front of the cabin 30. Likewise, an optional single-point hoist point 125 can be provided at a position that is generally to the rear of the viewing area of the passenger cabin 20, so as not to restrict, or to minimize interference with, upward visibility as viewed from within the cabin 20. For example a combination of a partial sphere 30 and access pressure vessel 40 as discussed in these embodiments can serve to move the CB backwards towards the access pressure vessel 40 compared with using only the partial sphere 30. This in turn allows the surface ballast tanks 95 to be positioned generally behind the desired field of view from the passenger compartment of cabin. In addition, selecting a tail up attitude for the surface mode positions all or a large portion of sphere 30 underwater, also further enabling position of the surface ballast tanks 95 rearward. Selecting an arrangement with the tail up surface mode attitude (i.e. the CB in surface mode shifted rearward), other components such as batteries 180 can also be moved rearward enabling a design with the CG further rearward than otherwise might be possible. In different examples, as more equipment is placed further back, the CB moves further back, generally irrespective of the actual weight of that equipment. The CG of the vessel can be designed to be in an optimally desired location below the CB depending on the size and weight of the trim weight 225, and different arrangements of trim weights may be selected. In one example a fixed trim weight is positioned forward of the CB, in addition to movable trim weight 225.

Figure 21:
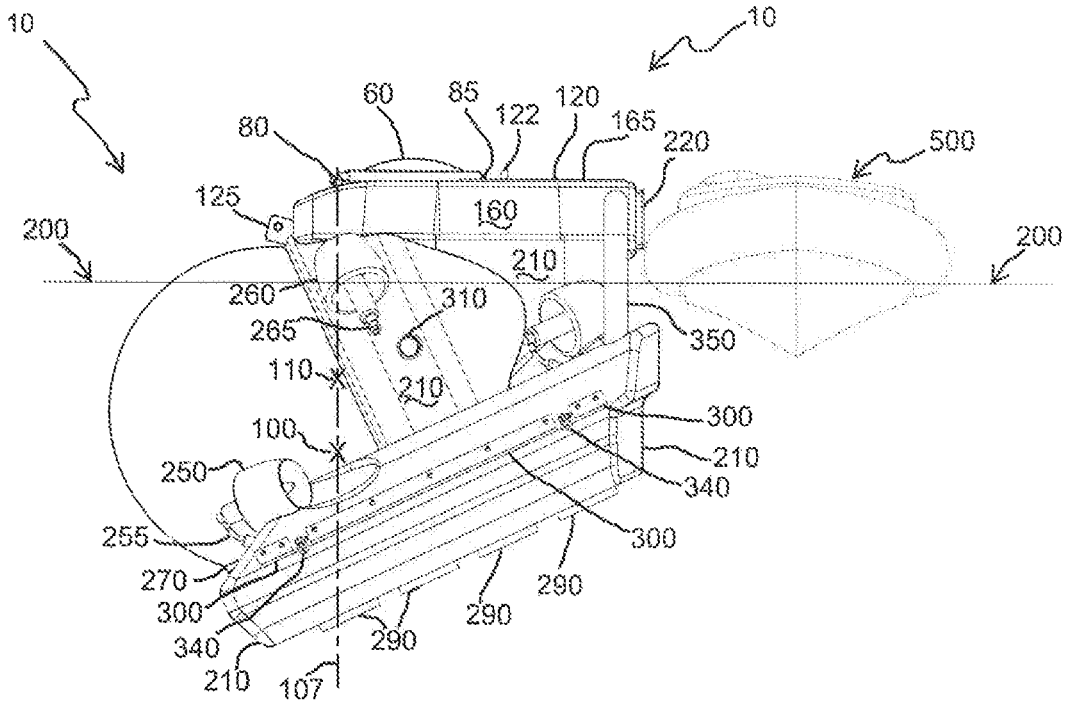
FIG. 21 is a side view of an underwater watercraft in accordance with the present invention situated at a water surface with an example of a tender craft.

In the illustrated embodiment, the centers of buoyancy of the ballast tanks 95 and/or 160 are positioned behind the CG 110 of the vessel 10. The ballast tanks 95 are also positioned below the half-way line 170 of the sphere 30 (illustrated with phantom line 170), and as such in a typical surface orientation of the vessel 10 remain submerged below the surface 200. As the ballast in tanks 95 is inflated, such as from air from air tanks 180, the watercraft adopts a tail elevated (also referred to as "tail up" or "angled") attitude, such as illustrated in FIG. 21. The optional upper ballast tanks 160 are positioned adjacent the hatch 60 and riser 70. In operation, the upper ballast tanks 160 optionally are drained using the high pressure air from air tanks 180. Alternatively, the upper ballast tanks 160 are wholly or partially gravity drained by operation of the submerged lower ballast tanks 95, and in the case of partial gravity draining, the last amount is drained using air supplied from the high pressure air tanks 180 via air lines. Although installation of, or operation of the upper ballast tanks 160 is optional, it is found that their use can increase surface stability. By utilizing a gravity drain system, the amount of air required to be supplied by the air tanks 180 may be reduced, increasing the air tank 180 fill cycle.

An optional housing 210 may be provided enclosing various operational components of the watercraft 10. For example, the housing 210 may enclose the ballast tanks 95, 160 and hatch assembly 50, for aesthetic and/or functional purposes. One functional purpose of the housing 210 may be to reduce drag in operation, thereby serving to increase operational time between refueling or battery charges.

A tail elevated attitude of the watercraft 10 at the water surface 200 is illustrated for example in FIGS. 19-23. An optional tender craft 500 is also illustrated. The tail elevated attitude of the watercraft 10 at the surface serves to maintain portions of the sphere 30 and passenger compartment 20 under the water surface 200, thus reducing the size requirements of the ballast tanks 95 and/or 160 by reducing the amount of volume required to be above the surface. This also serves to keep an increased volume of the cabin out of the sun or environmental conditions, reducing sun heating. Likewise, this promotes a safe access point for the tender craft 500 to tether at the rear of the watercraft. Optional rear bumpers 220 and/or front bumpers 610 are provided so as to protect the housing 210 and other elements of the watercraft 10 from contact with the tender craft 500. Alternatively the angle at surface could be achieved or "trimmed" using an adjustable trim weight 225 that can be moved back to front along the submersible, such as along a track. For example moving the trim weight 225 forward tends to move the center of gravity forward, increasing the angle, and alternatively moving the trim weight 225 towards the rear moves the center of gravity rearward, decreasing the amount of tail up attitude. Likewise, in submerged mode, the trim weight 225 can be moved to adjust the attitude as desired.

Other components of an illustrated embodiment include various thrusters for forward, backward, vertical and lateral (or longitudinal) positioning or motion of the watercraft 10. Examples of thrusters are lateral thrusters 250, and vertical thrusters 260. Operation of the lateral thrusters serves to move the vehicle forward, backwards, left and right, or to turn it laterally. Operation of the vertical thrusters 260 serve to adjust elevation (or amount of submersion), and to adjust roll. Power cables in electrical connection with batteries 185 and control signal wires in electrical connection with steering controls pass through conduits 255, 265 to their respective thrusters 250, 260. Although the batteries are illustrated as being adjacent the surface ballast tanks 95, they may be located at any desired location on the watercraft 10. For further steering control, one or more thrusters 250, 260 may be movably mounted. For example, in surface mode, it may be desired to retain the lateral thrusters 250 in an orientation generally co-planar with the surface plane 200, and to accomplish this, they may be movably mounted.

Various electronic controls and/or sensors may also be included, such as sonar 270 and USBL for tracking 280, and DVL 285 for navigation. Bumpers and feet also can be included as desired. For example bottom cushions 290 (such as rubber feet) can be provided to provide a protective contact surface such as for use in transport on a trailer or for bearing the vehicle weight when on a home vessel or port. In the illustrations, the bottom cushions 290 are positioned on the bottom surfaces 212 of the housing 210, below the lower ballast tanks 95, batteries 185 and air tanks 180. Side cushions 300 are also provided on the sides 214 of a lower portion of the housing 210. Side, forward and rear lights 310, 320 and 330, respectively, also may be provided to improve visibility such as in low lighting conditions, or at night. Other lights also may be included, such as adjustable lights 335 for directional lighting. Tie down points 340 are another option, such as for use in securing the watercraft 10 when out of the water. Towing the watercraft by attaching a tow line to the tie down pints 340, towing points 345, or any other structurally suitable portion of the watercraft 10. In such an embodiment, for example, the watercraft 10 may be towed backwards by attaching a tow line to the tow points 345. The angle of the watercraft and position of the tow points help lift the watercraft on top of the water surface, as opposed to pulling it under, reducing drag and improving the efficiency and speed of the towing operation.

A tie bar 350 or multiple tie bars 350 may be provide for passengers to hold on to, or to secure the watercraft 10 to a tender craft 500, such as using a securing cable. In an embodiment, the tie bars 350, also include securing hook points 360 where the securing cable may be attached or looped. The hoist point (grappling assembly) 125 may be located at any location on the watercraft that can be accessed by a crane or other grappling device. Safety buoy 370 also may be provided at any desired location. In the illustrated embodiment, safety buoy 370 is between the retractable handrails 120.

Figure 18:
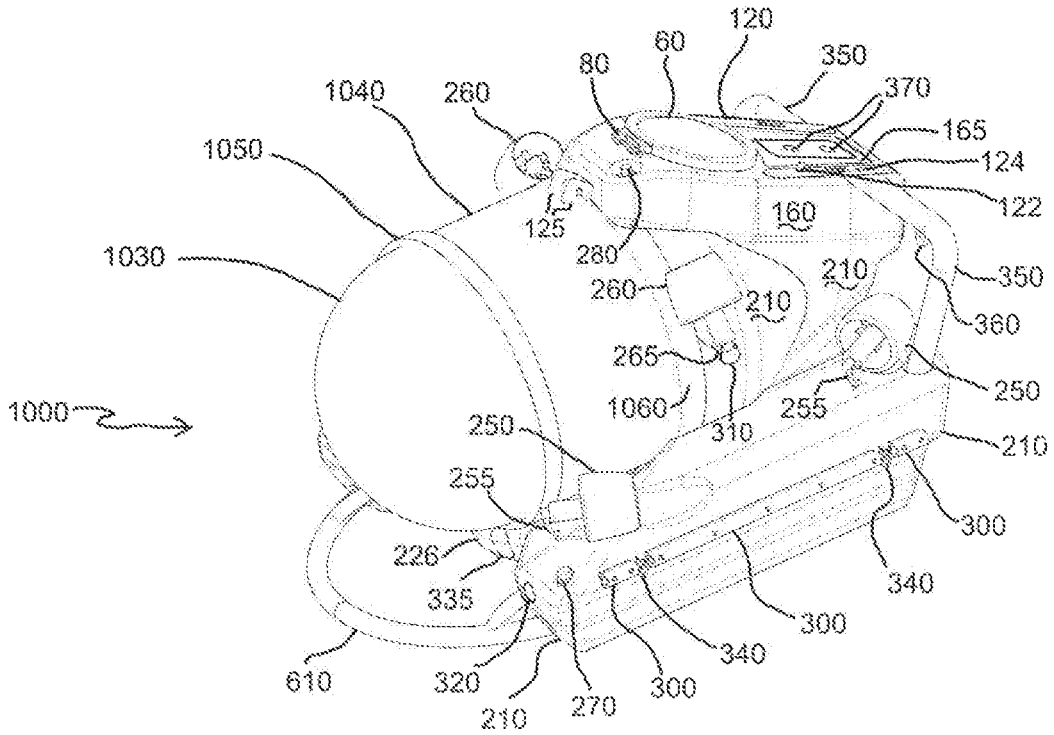
FIG. 18 is a perspective view of an elongated embodiment of an underwater watercraft in accordance with the present invention.
Figure 19:
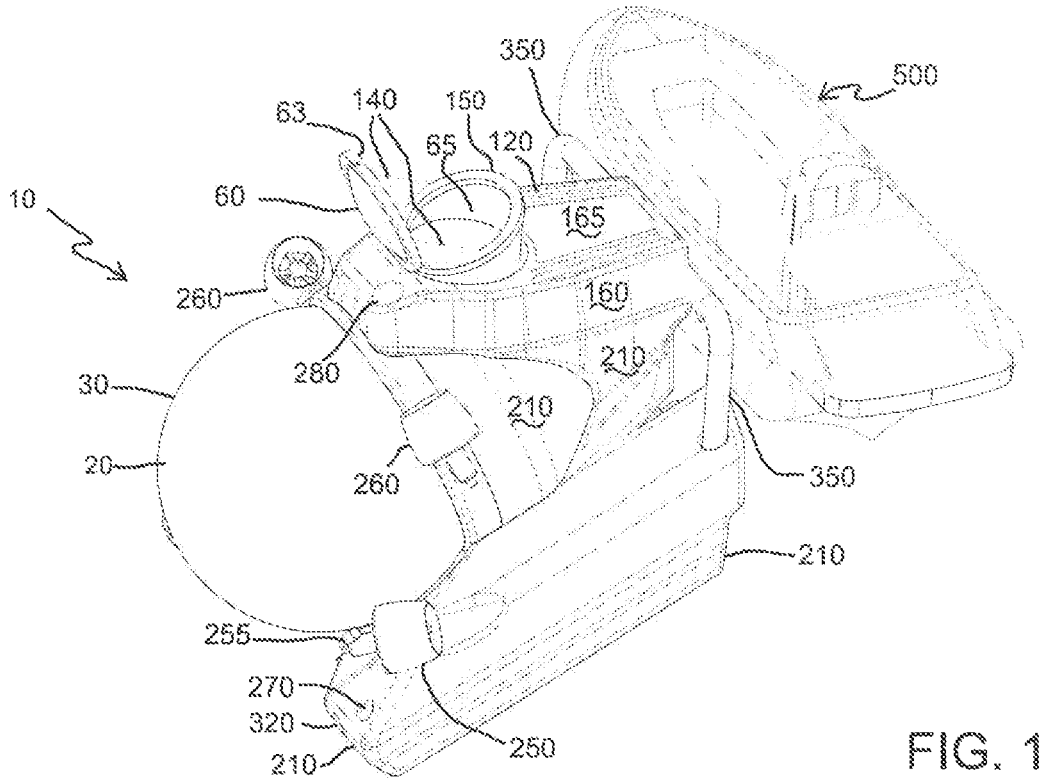
FIG. 19 is a perspective view of an underwater watercraft in accordance with the present invention situated at a water surface with an example of a tender craft.

Turning now to the interior of the passenger compartment 20, seating 380 for any number of passengers may be provided. In the illustrated embodiments, a three-seater and five seater version are illustrated. For larger numbers of passengers, more seats are added, and the size of the passenger compartment 20 is increased, such as by adding additional clear sections, or enlarging the sphere 30. An example of an elongated version 1000 of the watercraft is shown in FIG. 18. In the illustrated elongated version 1000, a transparent hemisphere 1030 is provided in the front, such as an acrylic half sphere. The hemisphere 1030 is connected to a transparent cylinder 1040 by any suitable connector assembly 1050. An example of a connector assembly would be a metallic pressure vessel ring and seal assembly. The end of the cylinder 1040 opposite the connector assembly 1050 is connected to the access pressure vessel 40 as described herein, such as via a second connector assembly 1060.

The seats 380 optionally may include designated passenger seats 380 towards the front, and a pilot seat 385 towards the rear, such as for tourism purposes, where the pilot is familiar with the domain. The seats towards the front would have better views outside of the watercraft through the sphere 30 because they are less unobstructed by seats in front of them, such as may promote tourism viewing. Alternatively, the pilot seat 385 may be designated to be toward the front to enable better viewing for navigation in less familiar areas, or for scientific research. Optionally the armrests 382 of the seats 380, 385 may be lifted or removed so as to promote easier motion by occupants. The seat bases 384 optionally are angled up for rider comfort, and so that they also are comfortable when the vehicle is at the surface 200, and the vehicle is at an angled tail up attitude. Alternatively, the seat bases are adjustable such that they automatically or manually can change angle depending up on the attitude of the watercraft. Angled seats also can be desirable when underwater, since many occupants may wish to sit with their knees higher than their hips. The angled seats provide a distributed cushioning over the entire upper leg of the occupant, important for longer excursions. This also allows for reducing the size of the passenger compartment 20 due to the more compact nature of the sitting position.

An example of a pilot control panel 390 is shown, although the controls may be located anywhere within the compartment 20 that can be accessed by the operator. A pilot monitor 392 also is illustrated. The pilot monitor 392 may be positioned in any location viewable by an operator, and alternatively may be movably mounted. The monitor may be used to view the exterior such as via front, rear, top, or bottom cameras, for monitoring system parameters such as battery level, compressed air pressure, external conditions sensors, sonar and so on. An air circulation system 400 also is provided, providing fresh breathable air such as from the air tanks 180, and supplied via conduits and circulated via fans (illustrated with reference numbers 400). The ventilation fans 400 also may be positioned so as to keep viewing surfaces free of internal condensation, such as by positioning them to blow air onto the windows and/or interior surface of the sphere 20.

Figure 22:
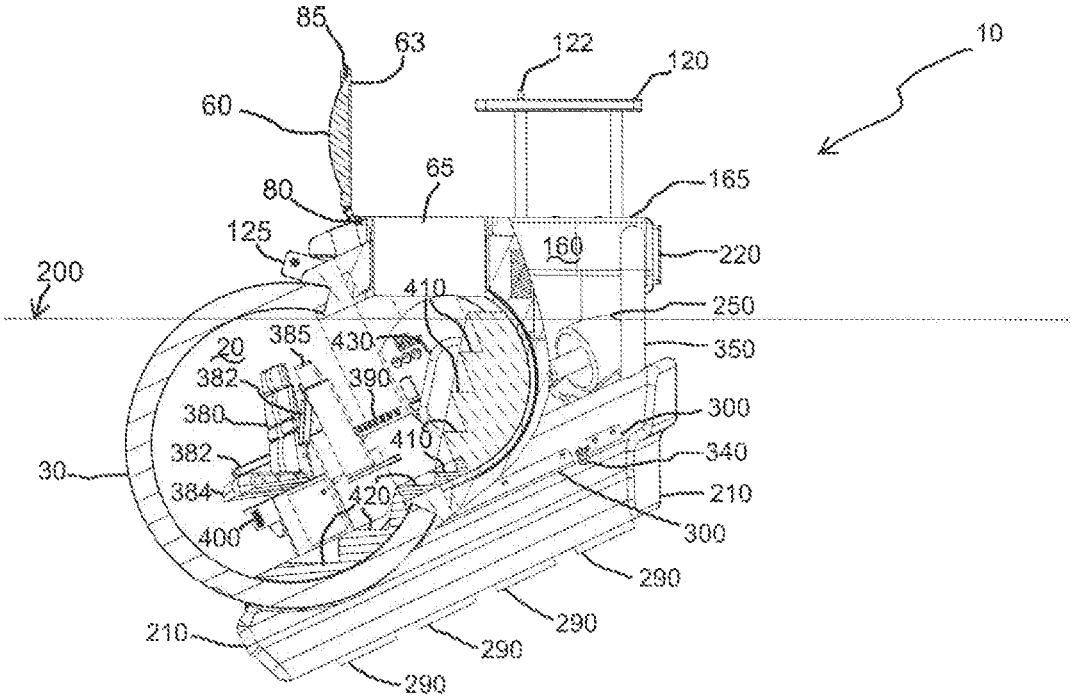
FIG. 22 is a cross-sectional port side view of an underwater watercraft in accordance with the present invention taken along A-A of FIG. 7, and situated at a water surface.
Figure 23:
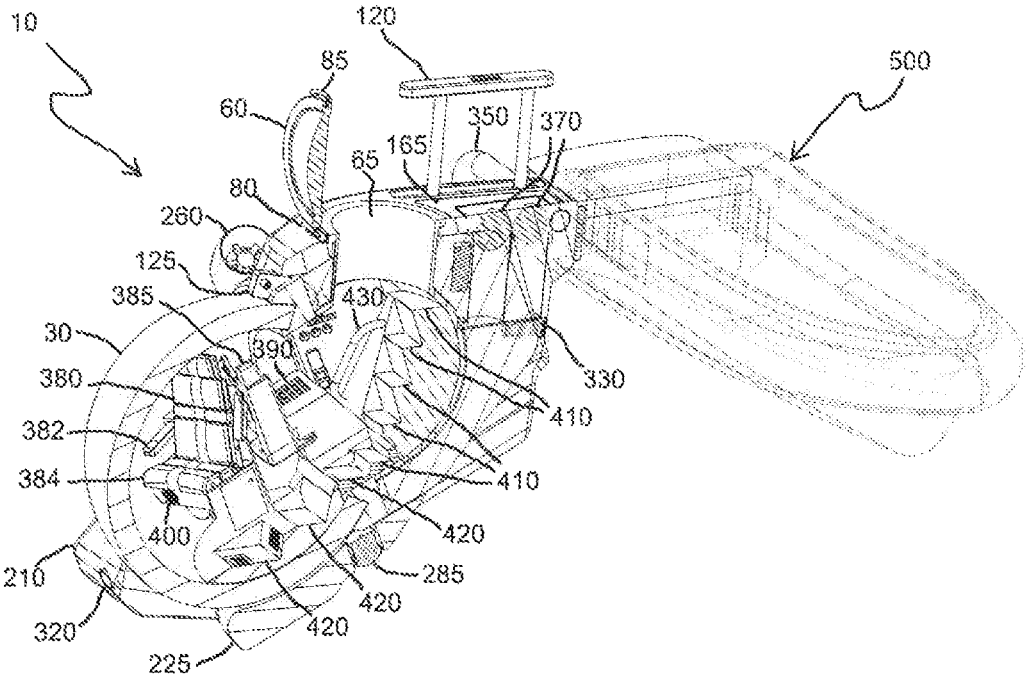
FIG. 23 is a cross-sectional perspective view of components of an underwater watercraft in accordance with the present invention.
Figure 24:
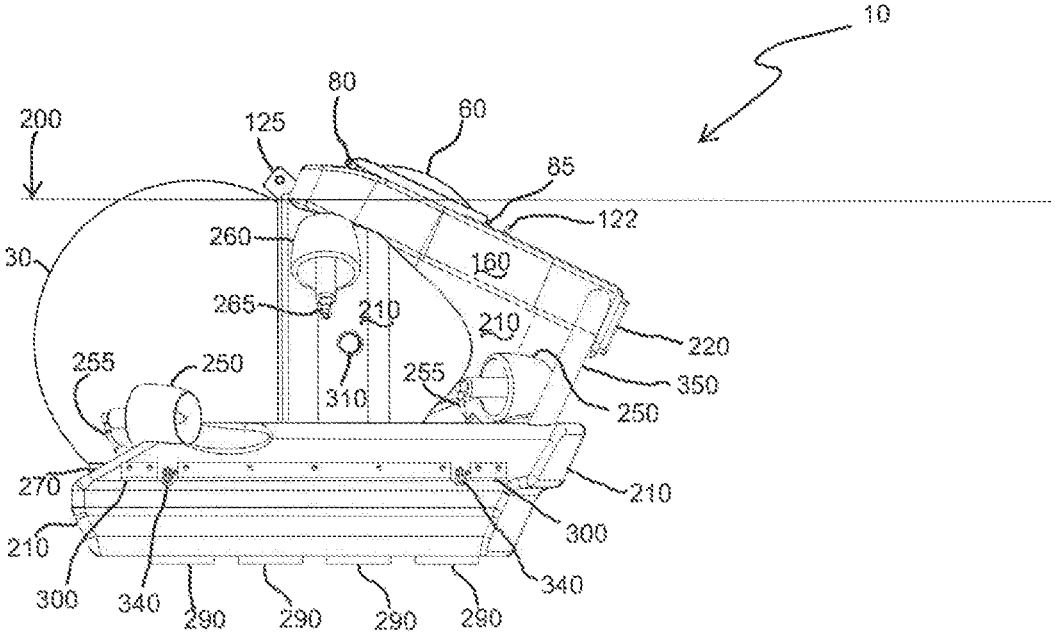
FIG. 24 is a port side view of an underwater watercraft descending below a water surface in accordance with the present invention.
Figure 25:
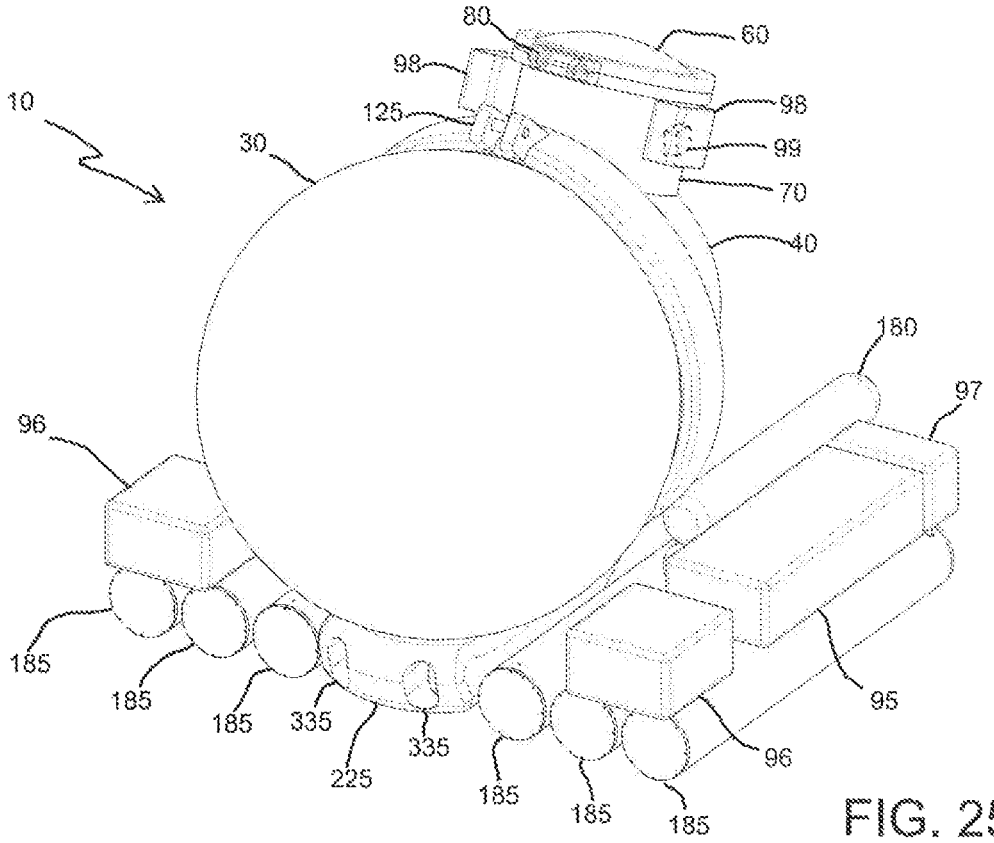
FIG. 25 is a front perspective view of components of an embodiment of an underwater watercraft in accordance with the present invention.
Figure 26:
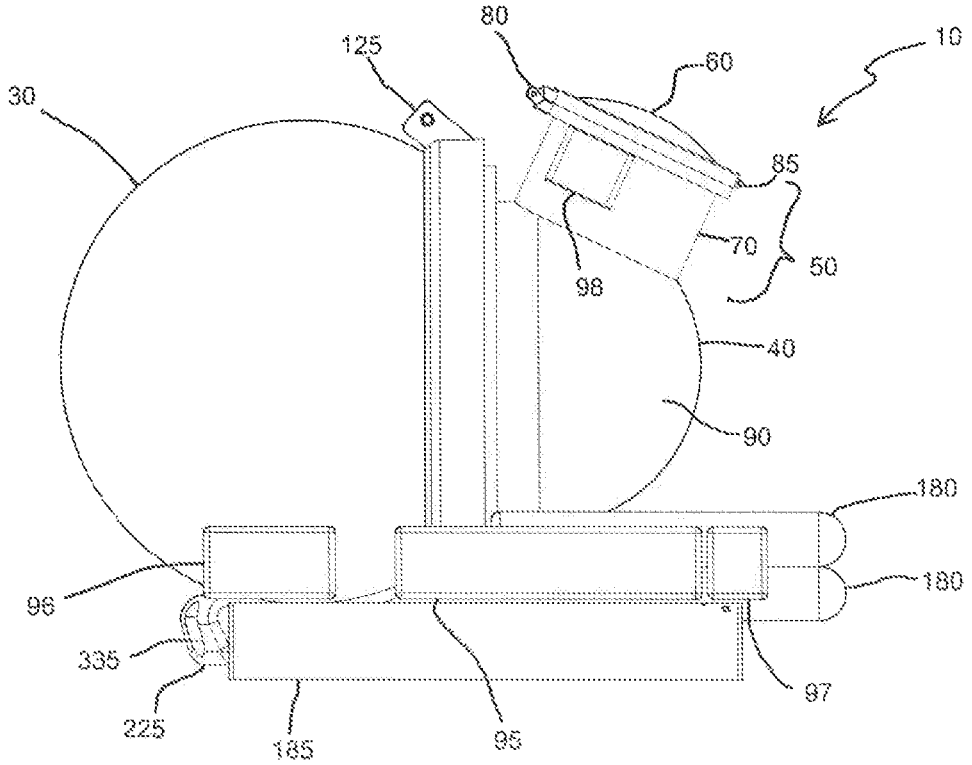
FIG. 26 is a side view of the components of an underwater watercraft of FIG. 25.
Figure 27:
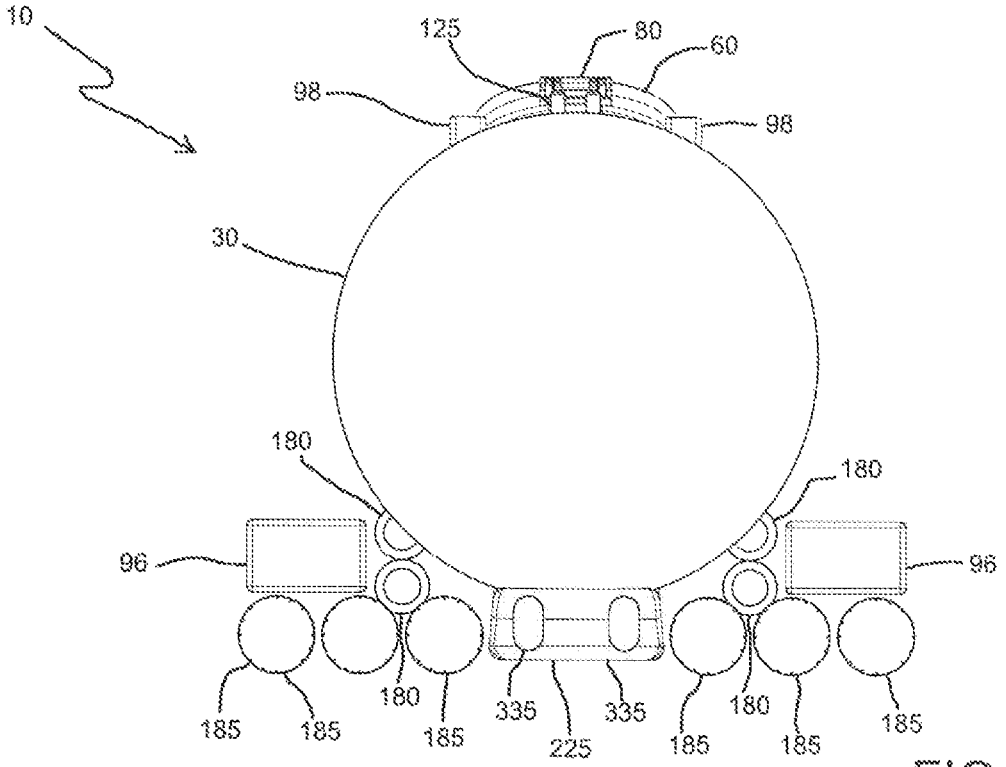
FIG. 27 is a front view of the components of an underwater watercraft of FIG. 25.
Figure 28:
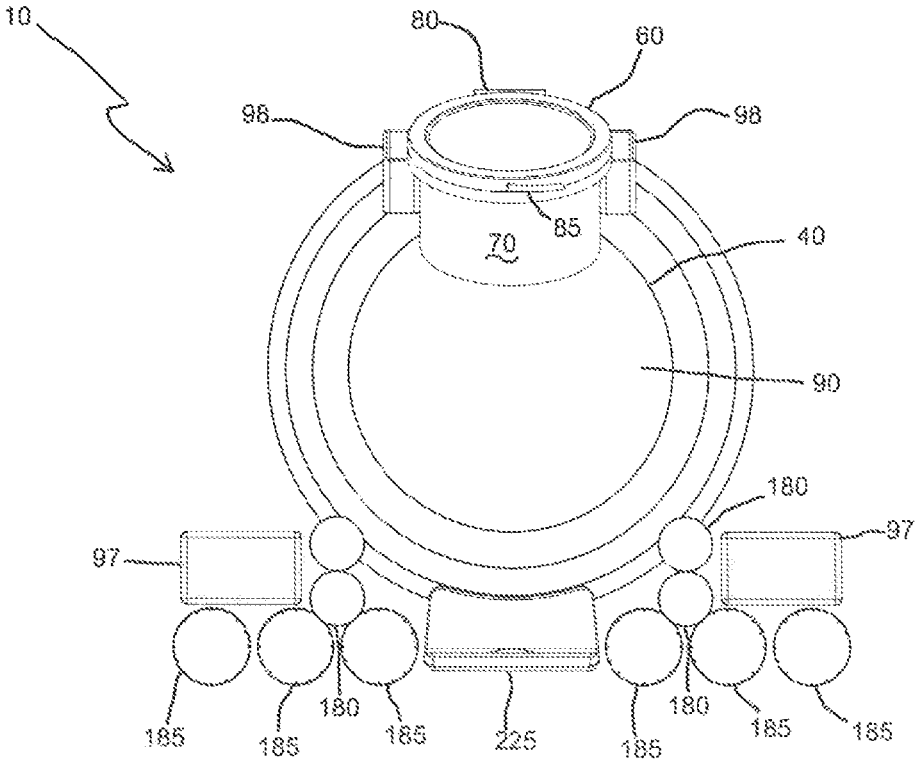
FIG. 28 is a rear view of the components of an underwater watercraft of FIG. 25.
Figure 29:
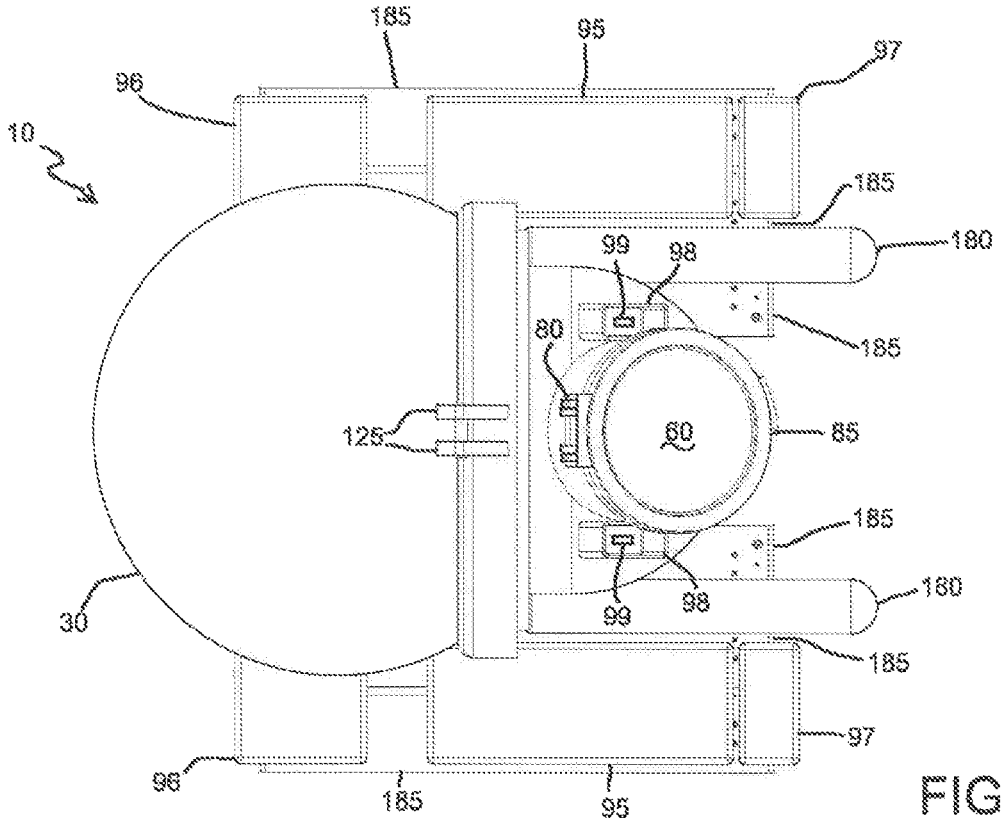
FIG. 29 is a top view of the components of an underwater watercraft of FIG. 25.
Figure 30:
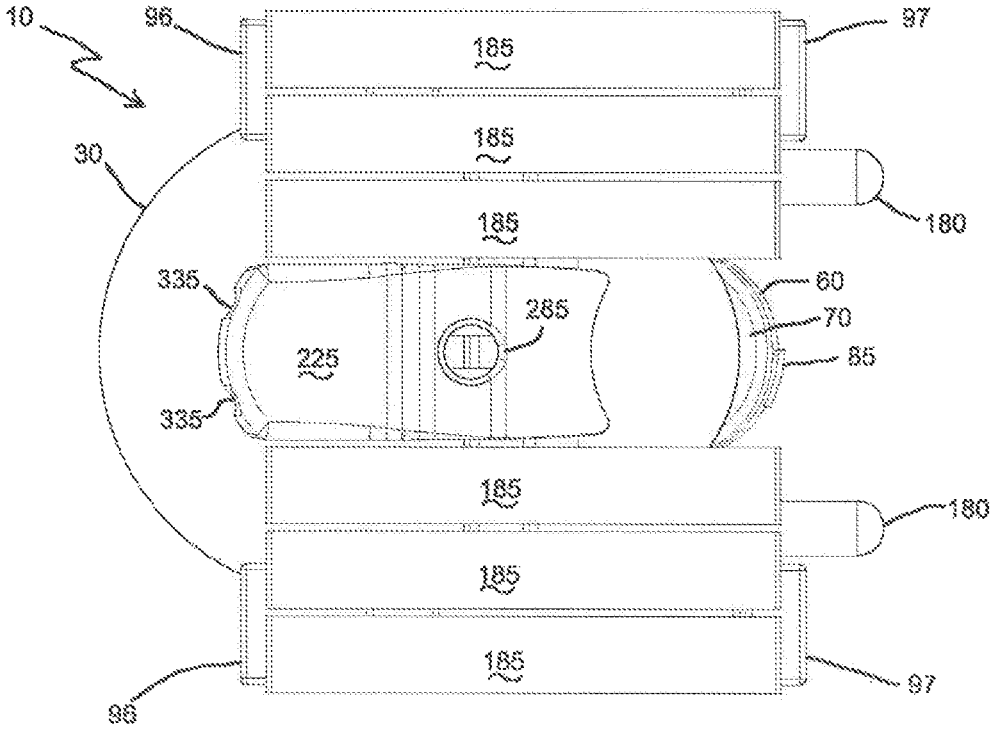
FIG. 30 is a bottom view of the components of an underwater watercraft of FIG. 25.
Figure 31:
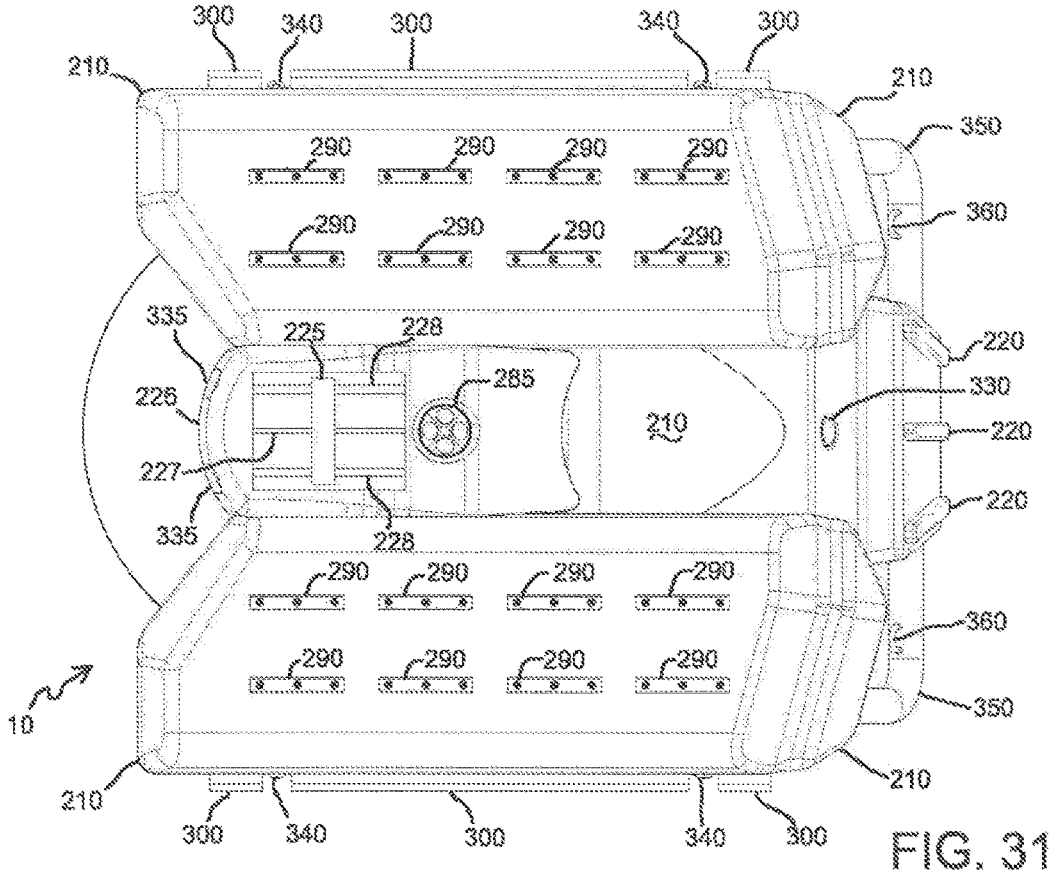
FIG. 31 is a bottom view of an underwater watercraft in accordance with the present invention with a partial cutaway showing internal components.
Figure 32:
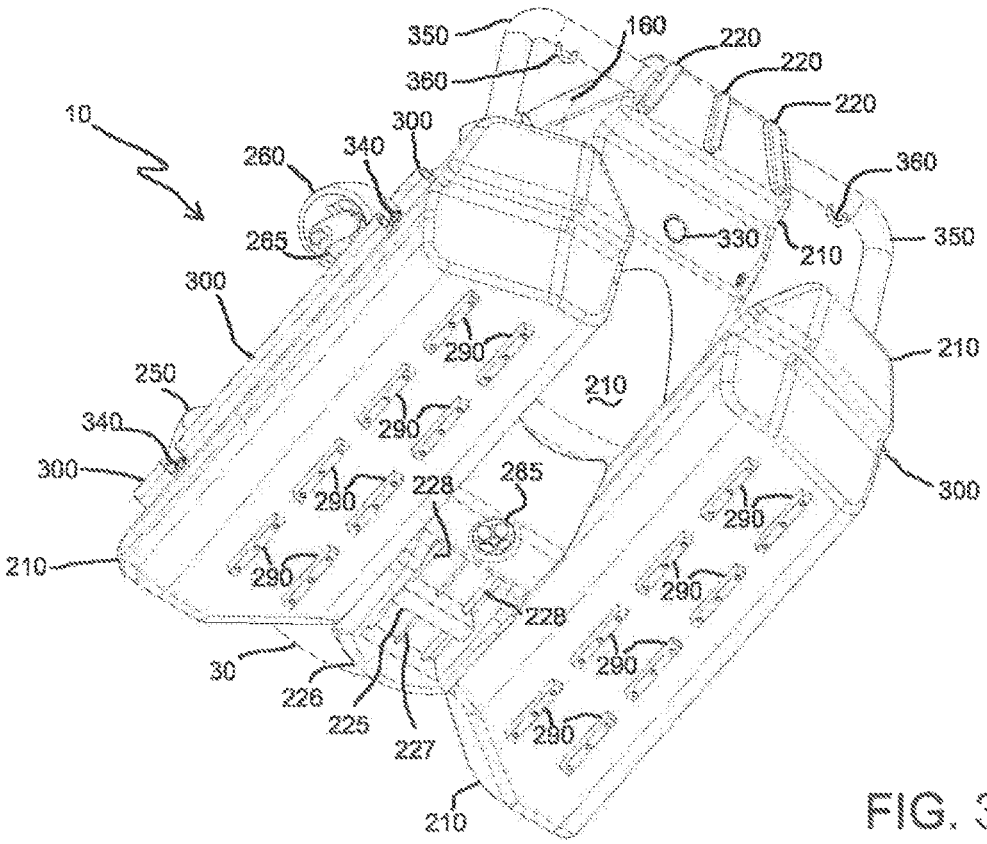
FIG. 32 is a perspective view of the underwater watercraft of FIG. 31.
Figure 33:
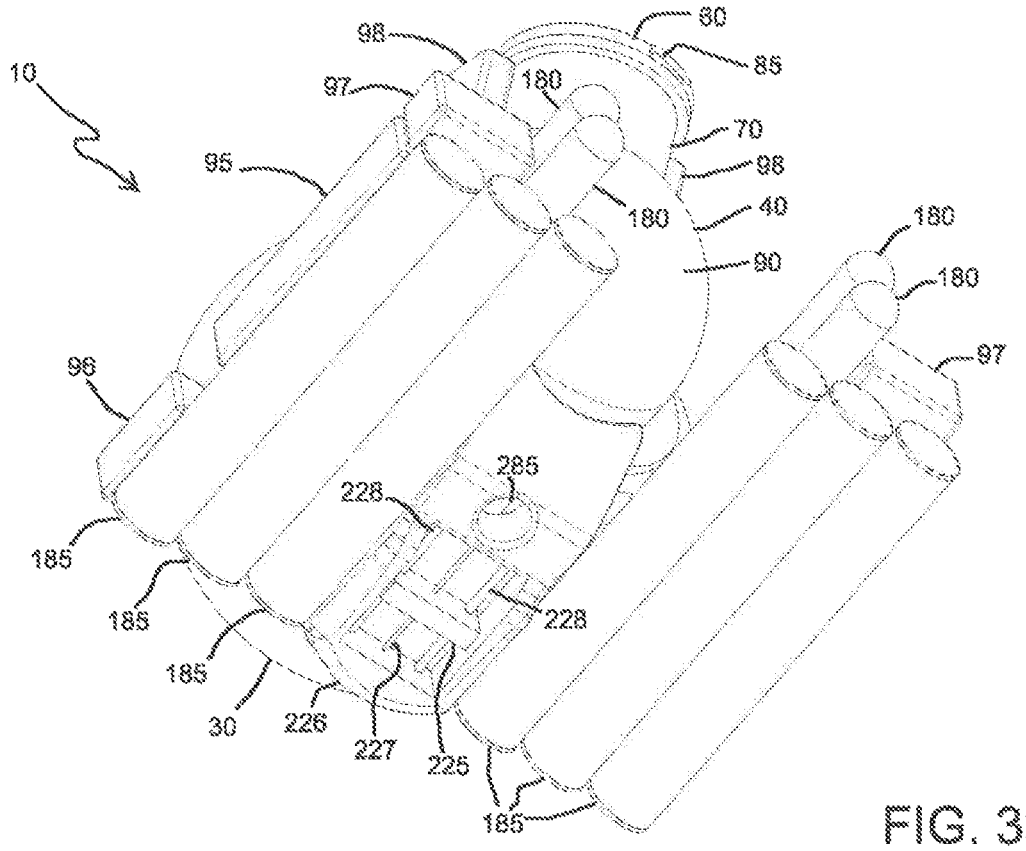
FIG. 33 is a perspective view of components of the underwater watercraft of FIG. 31.
Figure 34:
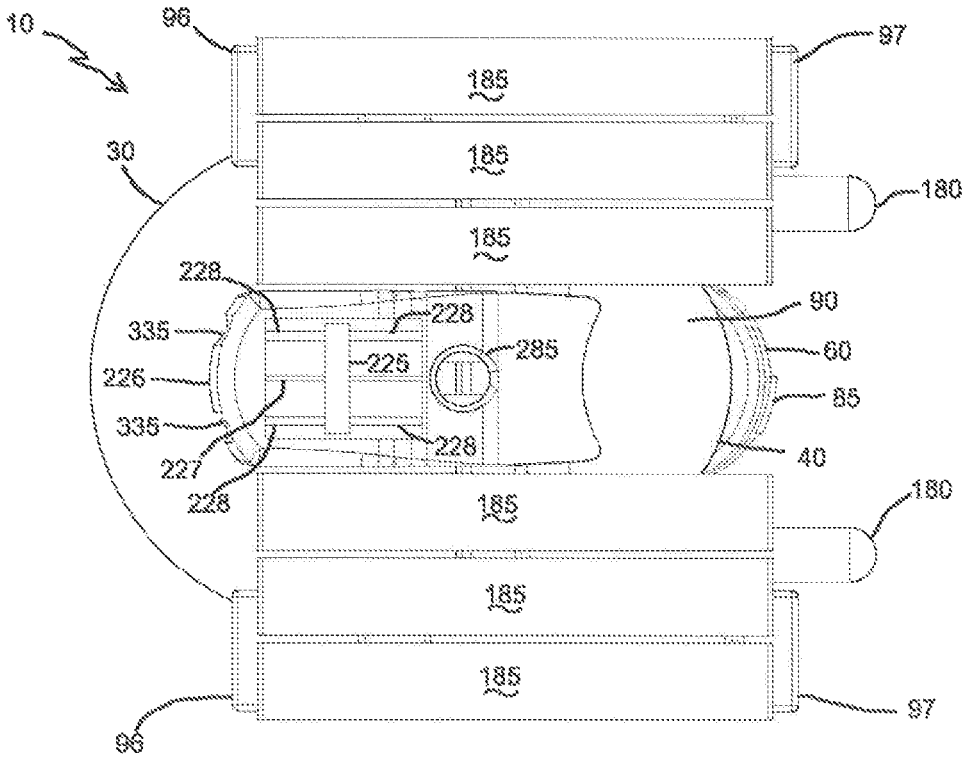
FIG. 34 is a bottom view of components of the underwater watercraft of FIG. 31.

Other optional elements may be included in the interior of the passenger compartment 20 in order to enhance passenger comfort and ingress/egress movement. For example, step angles are selected in order to make ingress/egress easier in an embodiment in which the surface attitude is angled, as illustrated in FIGS. 21 and 22. Ladder steps 410 are provided in the access portion, for the occupants of the passenger compartment 20 to climb out via the port assembly 50. The ladder steps are angled so as to be generally parallel to the surface of the water 200, and perpendicular to the force of gravity. Cabin floor steps 420 also may be provided so that occupants of the front seats 380 may use them to move from the front to the rear of the compartment 40 at the surface attitude. In operation submerged, the steps 410, 420 are at an angle not parallel to the surface 200 because the attitude is horizontal, as opposed to generally tail up as at a surface. Optional handrail 430 for holding on ladder steps 410 also may be provided. In an embodiment as illustrated in FIGS. 22 and 23, one or more of the seats 380, 385 may be movable so as to clear an exit or entry path within the compartment. In the illustration, seat 385 is folded out of the way.

Figure 35:
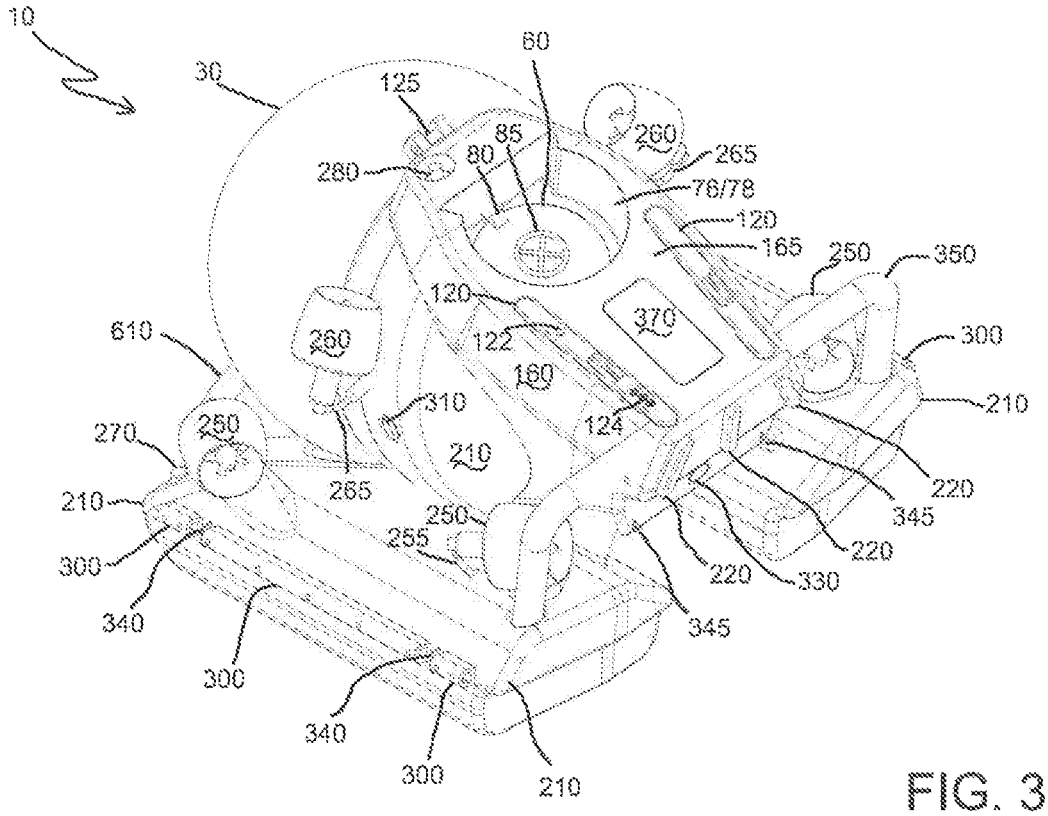
FIG. 35 is a rear perspective view of an underwater craft in accordance with the present invention.
Figure 36:
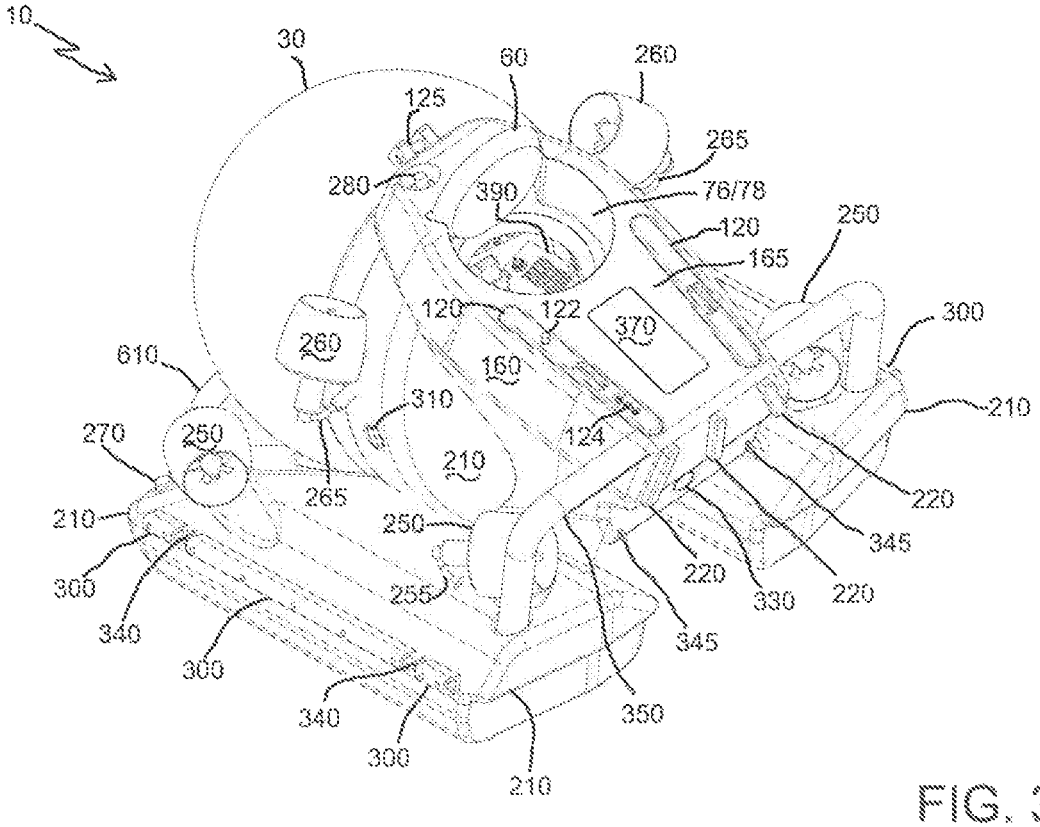
FIG. 36 is a rear perspective view of an underwater craft in accordance with the present invention.
Figure 37:
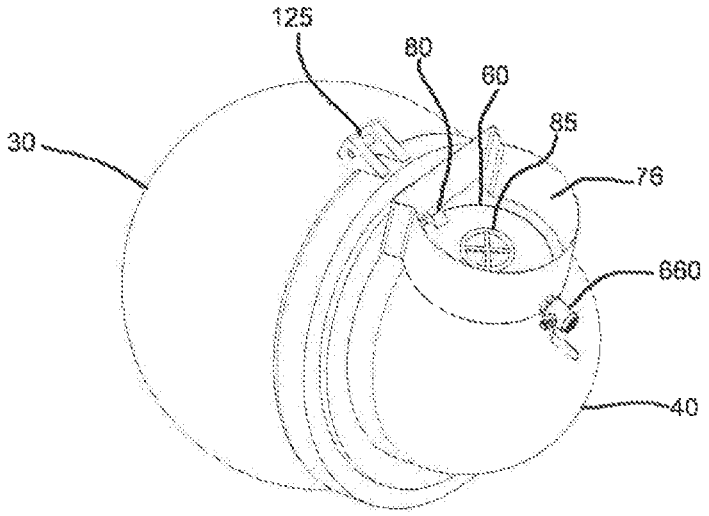
FIG. 37 is a rear perspective view of components of an embodiment of an underwater craft in FIG. 35.
Figure 38:
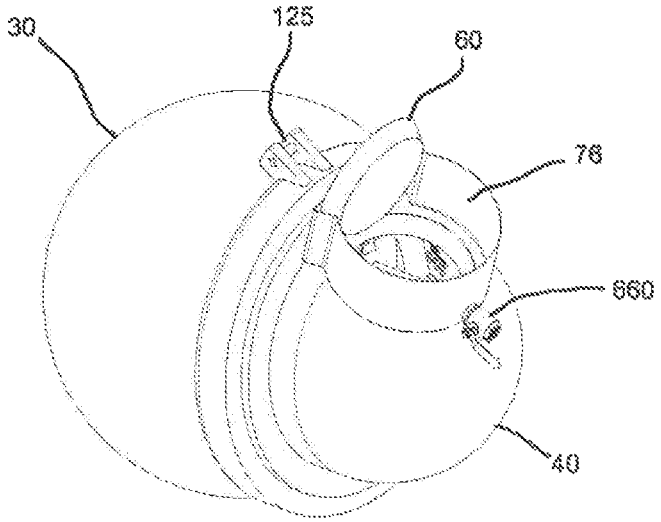
FIG. 38 is a rear perspective view of components of an embodiment of an underwater craft in FIG. 35.
Figure 39:
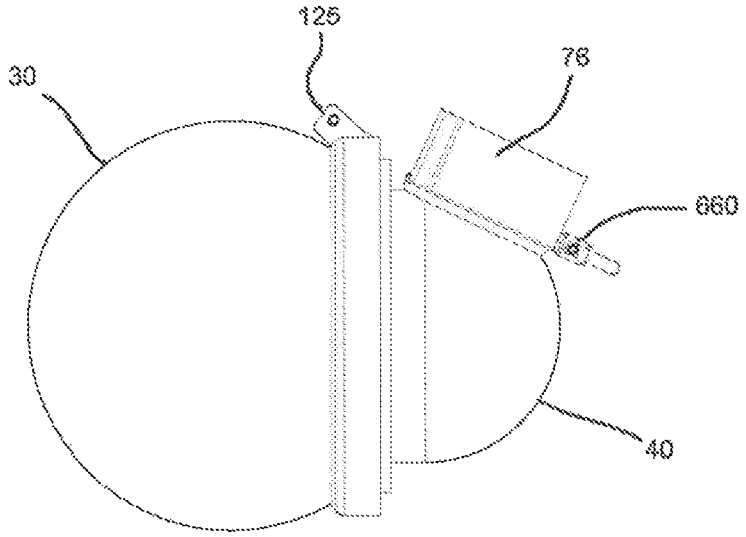
FIG. 39 is a side view of components of an embodiment of an underwater craft in FIG. 35.
Figure 40:
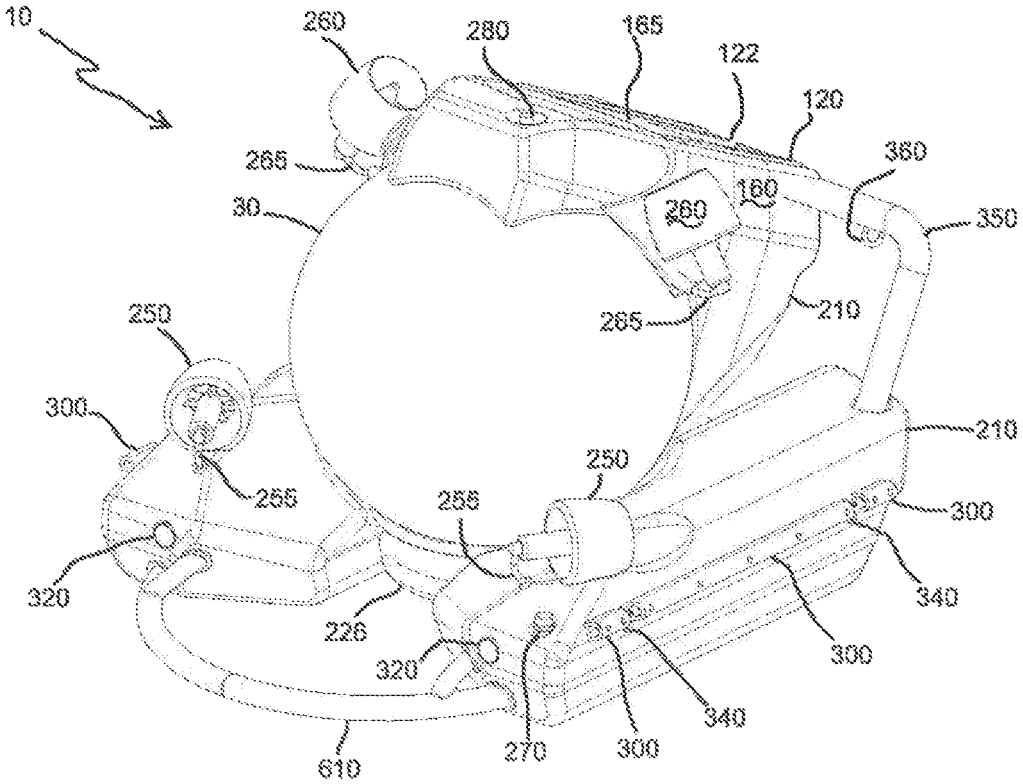
FIG. 40 is a front perspective view of an underwater craft in accordance with the present invention.
Figure 41:
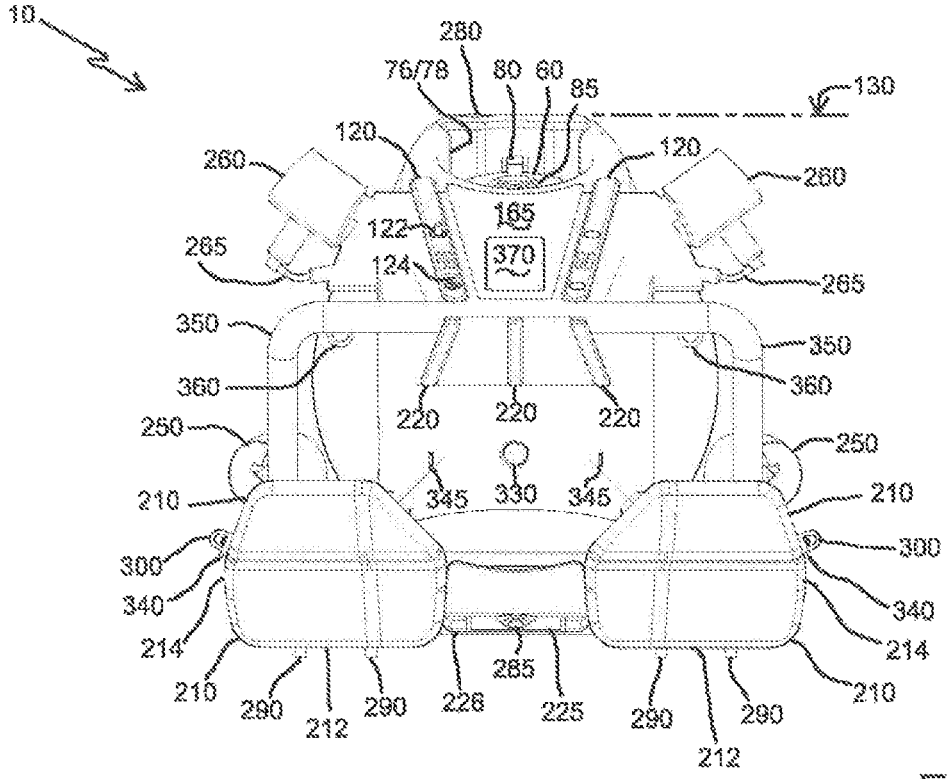
FIG. 41 is a rear plan view of an underwater craft in accordance with the present invention.
Figure 42:
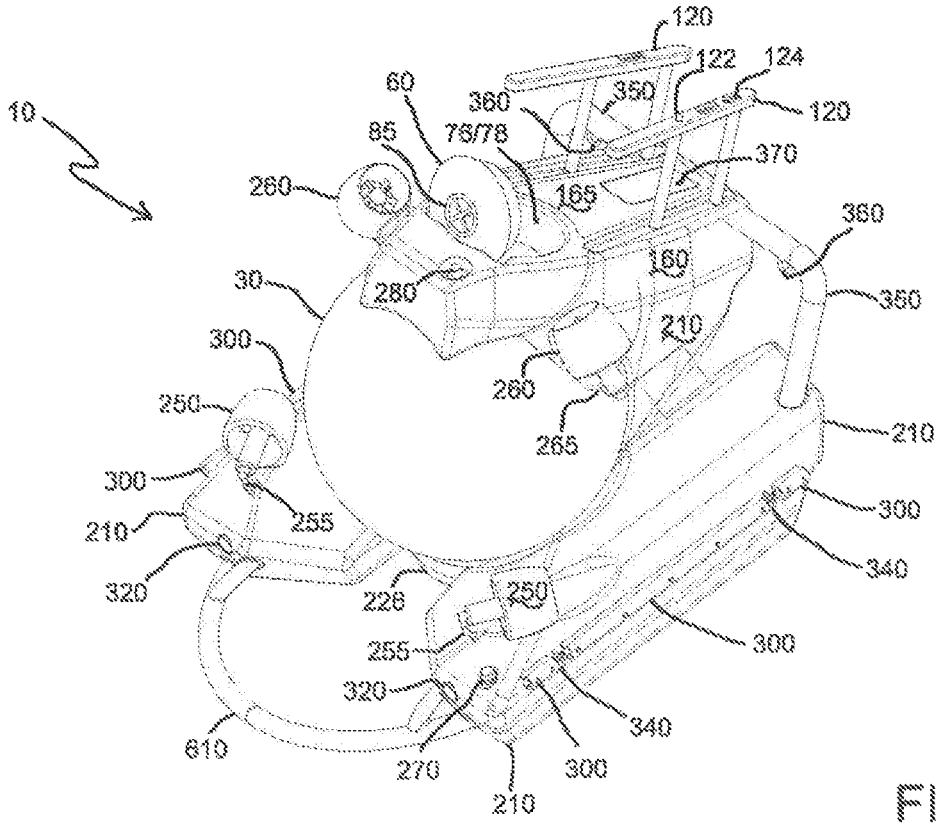
FIG. 42 is a front perspective view of an underwater craft in accordance with the present invention.
Figure 43:
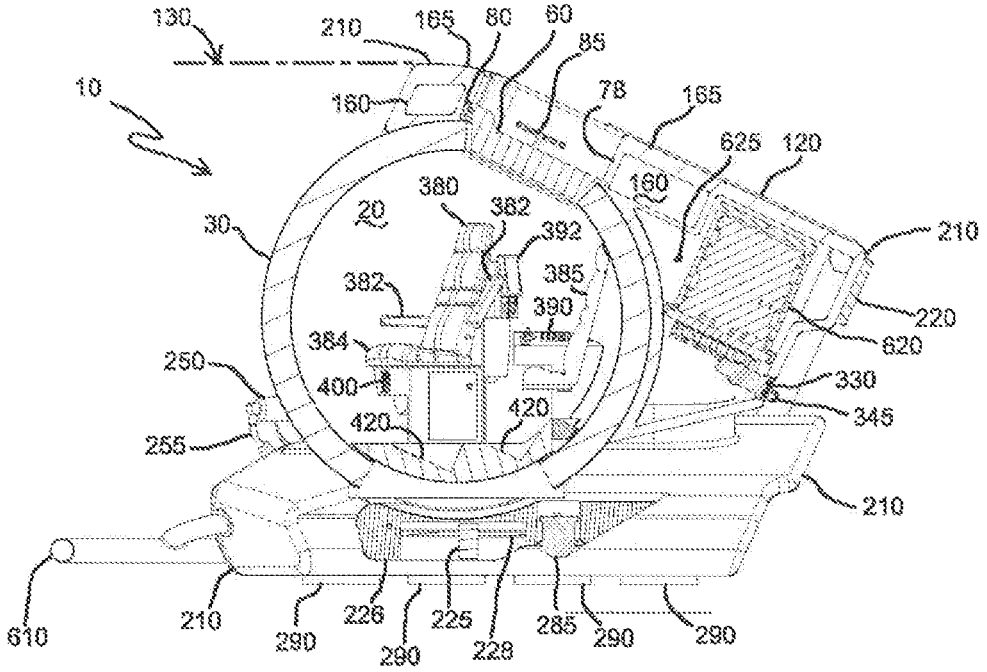
FIG. 43 is a cross sectional side view of an underwater craft in accordance with the present invention.

It should be appreciated that the hatch 60 can be situated at any location on the watercraft 10 that will enable ingress and egress from the watercraft such that water does not flow into the inside of the watercraft 10, or splashing is reduced. Likewise, the riser 70 optionally may not be included on the watercraft 10, for example, in one alternate embodiment illustrated in FIGS. 35-39, the hatch 60 is positioned toward the bottom of the riser 76/78. The riser 70 may be a pressure tight part of the access pressure vessel as shown in FIGS. 1-34, or the riser 76/78 may be a free flooded (non-pressure tight) part that is attached around the hatch via a fluid tight seal or connection. The riser 76 may be a separate component fixed around the hatch as shown in FIGS. 37-39, or may be a byproduct of a part such as housing 210 illustrated in FIGS. 35-36, where the riser 78 is created by the shape of the housing 210 around the hatch, providing the housing is connected via a fluid tight seal or connection around the hatch. In addition, optionally a valve assembly 660 is provided. The valve assembly 660 may include various elements, such as for example, a valve alone, or a valve and pump combination, or a one way low pressure check valve with or without a pump. The valve assembly 660 serves to allow for outflow of any water that is in the riser 76/78 above the hatch 60 when at surface. It is desirable to remove such water before opening the hatch so that the water does not flow into the interior of the watercraft 10, when the hatch is opened, and to increase buoyancy at surface, effectively acting as a surface ballast tank 160. In an embodiment in which the valve assembly 660 includes a one way check valve, the check valve allows the water to drain out of the riser but not return into it. Optionally the valve assembly 660 includes a remotely controlled valve, such as a hydraulically or electronically controlled valve. In this way, the valve may be operable from the interior of the watercraft 10, and/or the exterior of the watercraft, such as by operators in the tender vessel 500 or by others situated on the outside of the watercraft 10. Optionally the water could be removed from the riser space above the hatch by a pump included in the valve assembly 660, remotely operated from the interior of the watercraft and/or the exterior of the watercraft. Benefits of having the hatch at the bottom of the riser include but are not limited to: Reduced displacement of the watercraft; smaller surface buoyancy tanks 95,96,97 and 160 are required; more efficient manufacture of the access pressure vessel.

In an embodiment illustrated in FIGS. 40-56, the hatch 60 is positioned on an upper portion of the passenger compartment 20 or sphere 30. For ingress/egress, the hatch location on the sphere 30 is selected such that it is above the waterline 200 in a surface mode of operation, although it should be acknowledged that the hatch could be below the waterline as long as the riser 76/78 extended above the waterline and the water above the hatch was evacuated from the space provided by the riser A riser 76/78 may be affixed around the hatch, for example if the hatch is positioned directly on the sphere 30, or alternatively, the hatch 60 may be positioned at the top of the riser 70. The riser 70 may be a pressure tight part with the hatch on the top, or the riser 76/78 may be a free flooded (non-pressure tight) part that is attached around the hatch via a fluid tight seal or connection. The riser 76 may be a separate component fixed around the hatch or may be a byproduct of a part such as housing 210, where the riser 78 is created by the shape of the housing 210 around the hatch, providing the housing is connected via a fluid tight seal or connection around the hatch. Another optional element is a valve 660 or a valve and pump combination 660 or a one way low pressure check valve 660. The valve 660 serves to allow for outflow of any water that is in the riser 76/78 above the hatch 60 when at surface. It is desirable to remove such water before opening the hatch so that the water does not flow into the interior of the watercraft 10, when the hatch is opened. An optional Electronics Pressure Vessel 620 may be included to provide extra space for components, and is located in a compartment 625. Attachment arms 630 fix the electronics pressure vessel to the watercraft 10. Bulkheads 640 allow for connections to be made between the electronics pressure vessel 620, battery pods 185, cabin 30 and equipment such as thrusters 250,260. Displacement provided by the electronics pressure vessel 620 can serve to move the CB backwards towards the electronics pressure vessel compared with just using the sphere 30.

Figure 44:
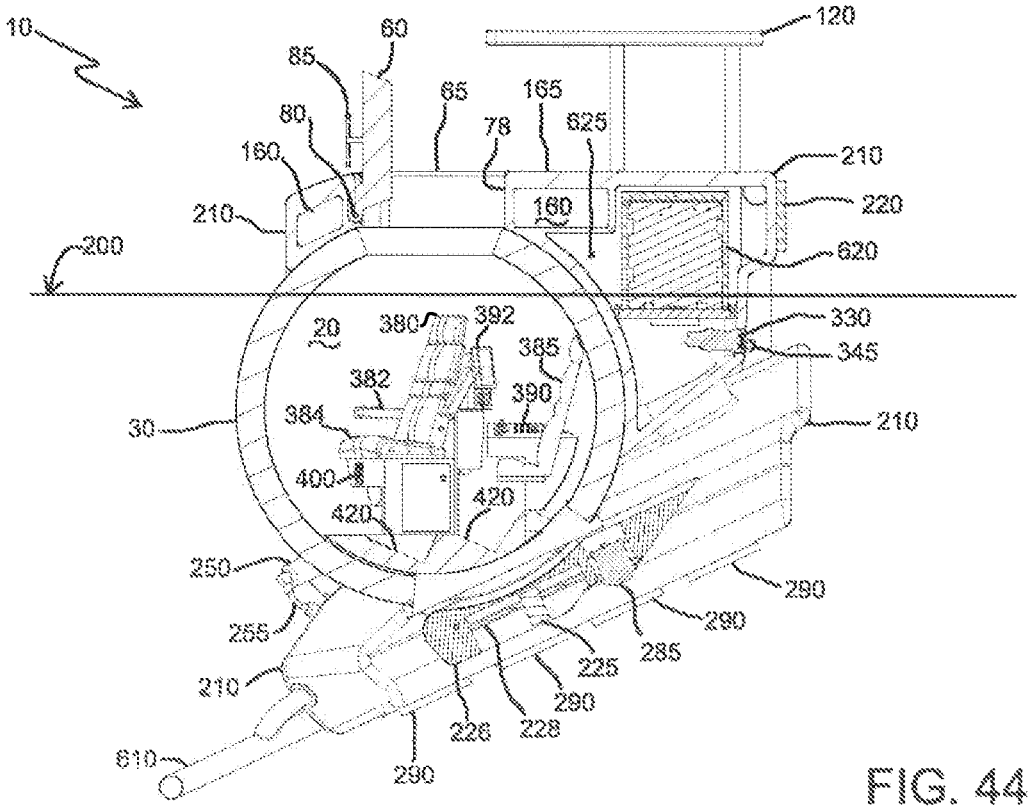
FIG. 44 is a cross sectional side view of an underwater craft in accordance with the present invention, situated at the water surface.
Figure 45:
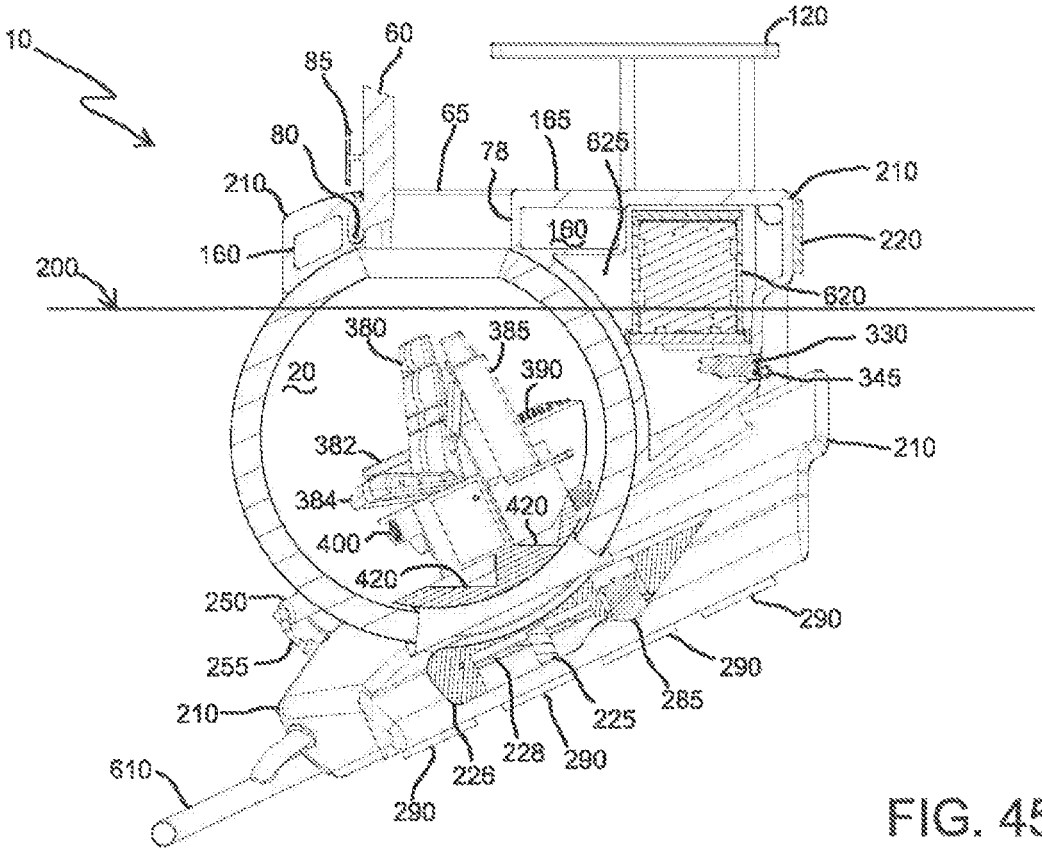
FIG. 45 is a cross sectional side view of an underwater craft in accordance with the present invention, situated at the water surface.
Figure 46:
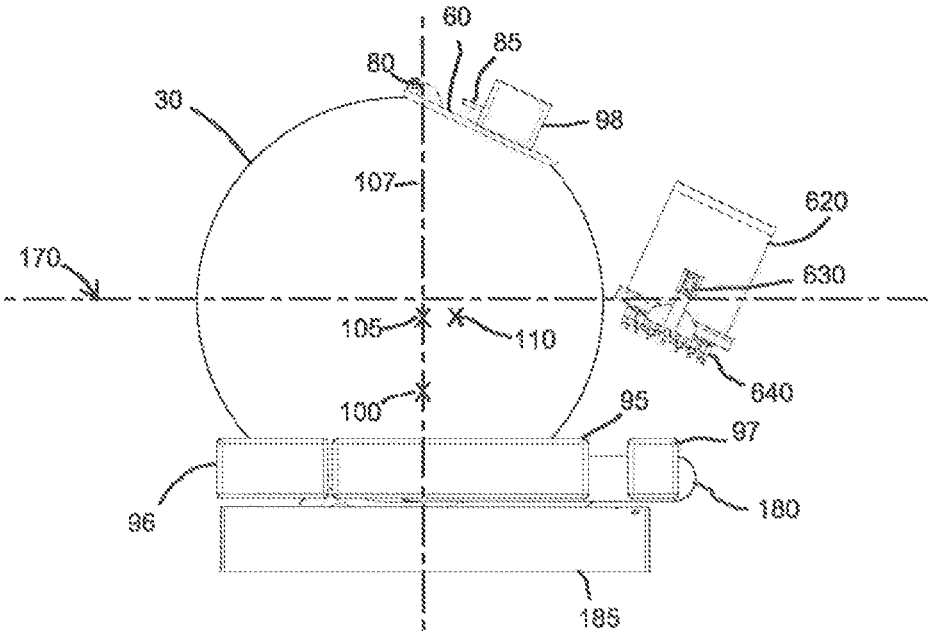
FIG. 46 is a port side view of components of an embodiment of an underwater craft in FIG. 40
Figure 47:
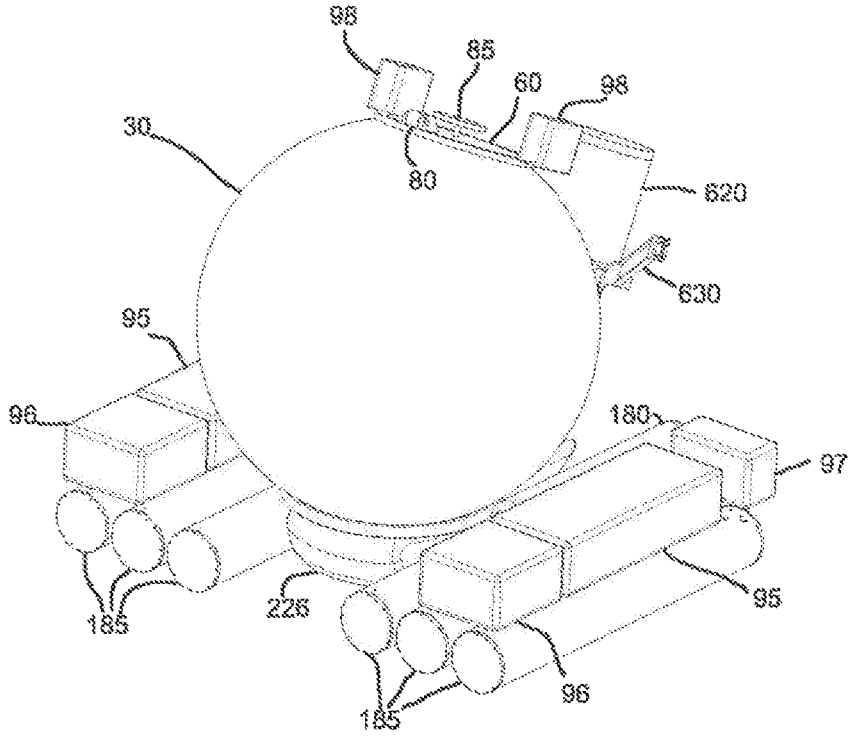
FIG. 47 is a front perspective view of components of an embodiment of an underwater craft in FIG. 40.
Figure 48:
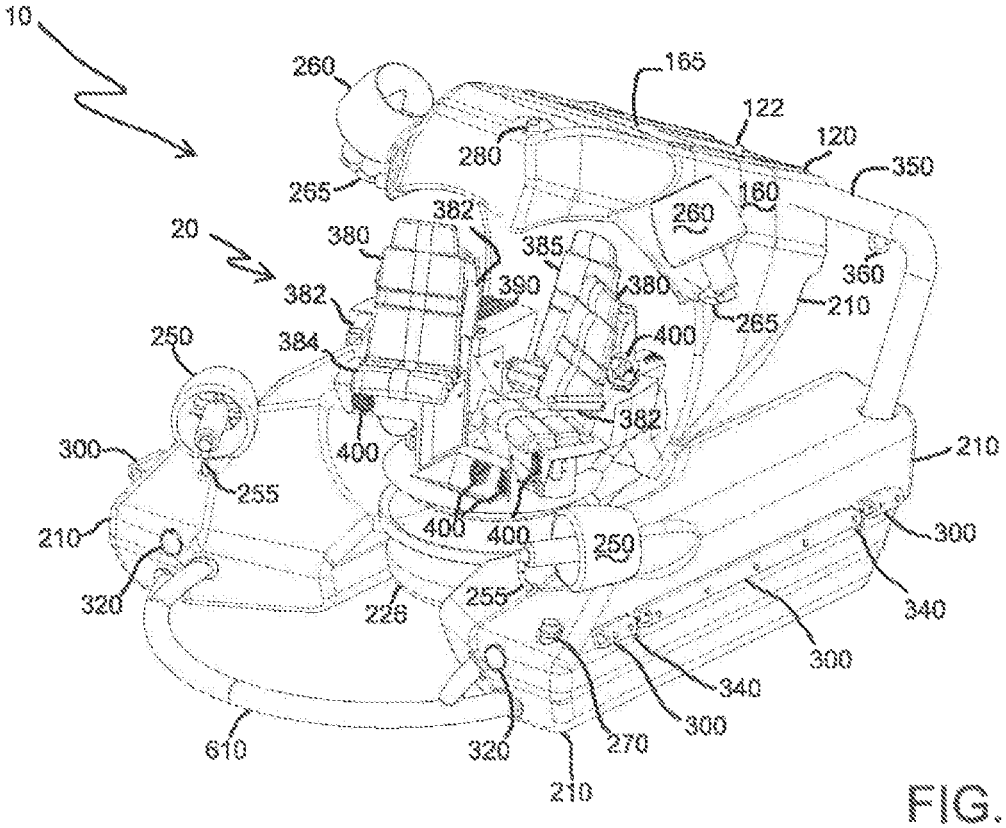
FIG. 48 is a front perspective view of the interior of the passenger compartment and components of an embodiment of an underwater craft in FIG. 40.
Figure 49:
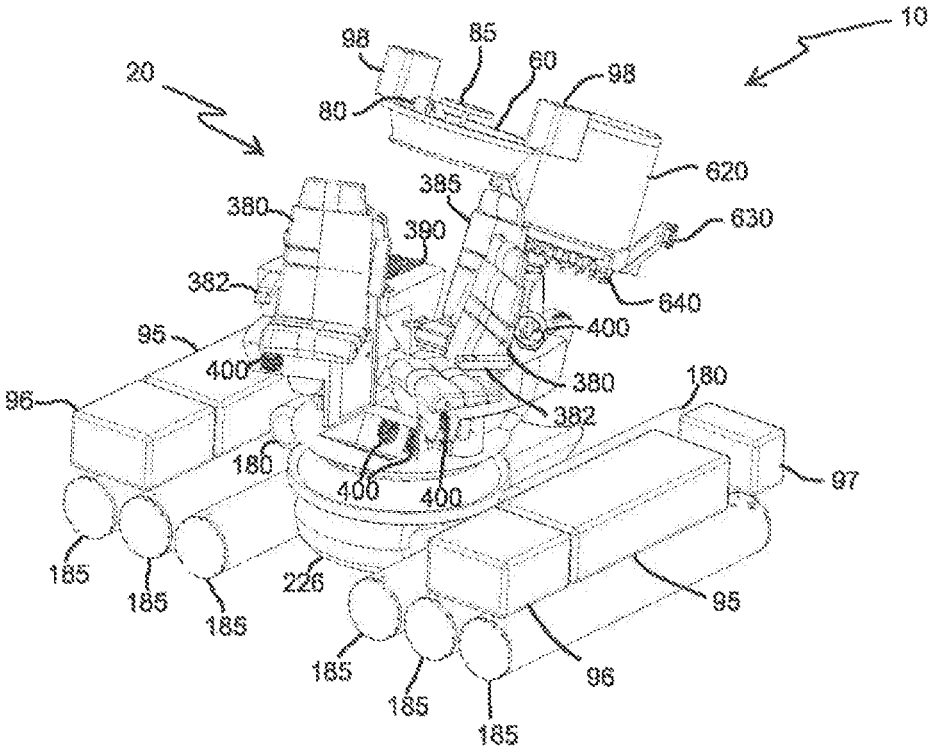
FIG. 49 is a front perspective view of components of an embodiment of an underwater craft in FIG. 40.
Figure 50:
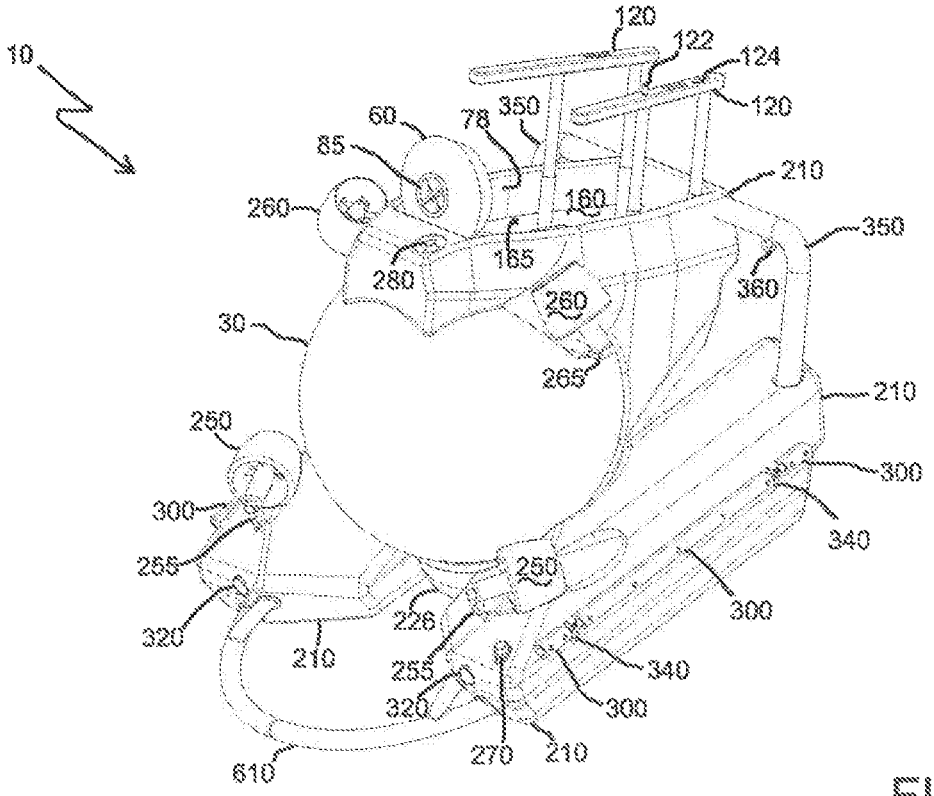
FIG. 50 is a front perspective view of an underwater craft in accordance with the present invention.
Figure 51:
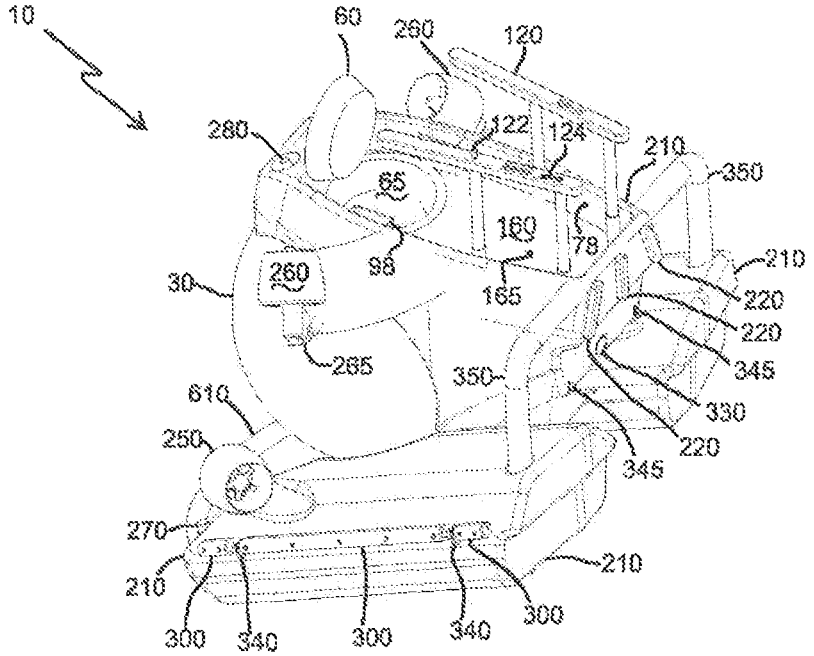
FIG. 51 is a rear perspective view of an underwater craft in accordance with the present invention.
Figure 52:
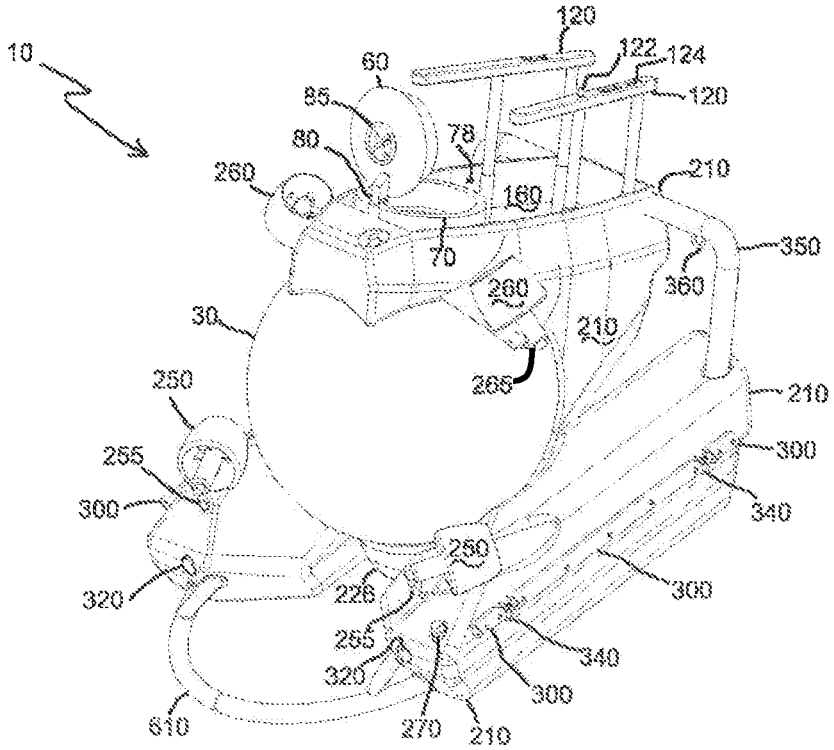
FIG. 52 is a front perspective view of an underwater craft in accordance with the present invention.
Figure 53:
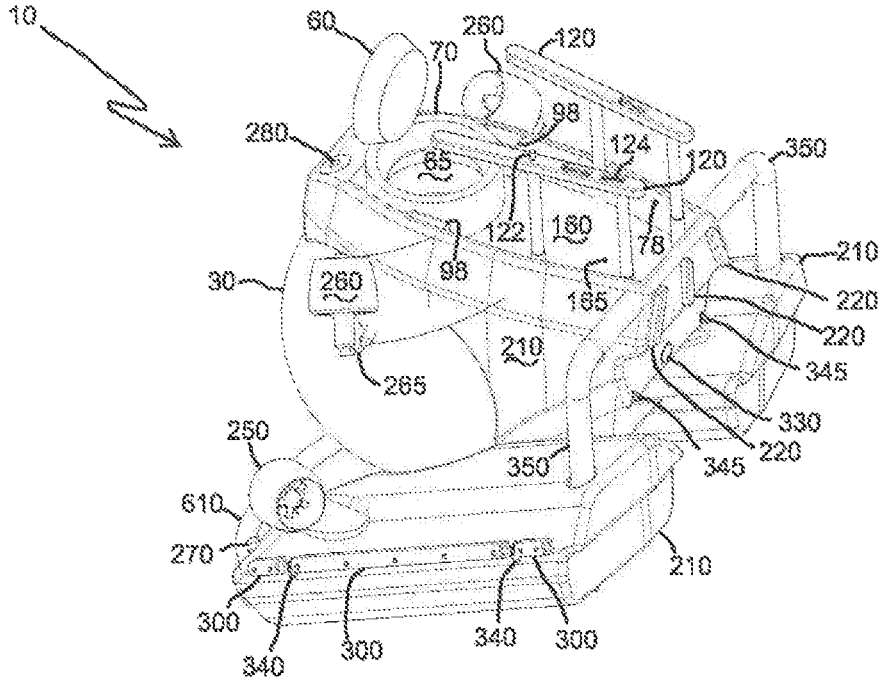
FIG. 53 is a rear perspective view of an underwater craft in accordance with the present invention.
Figure 54:
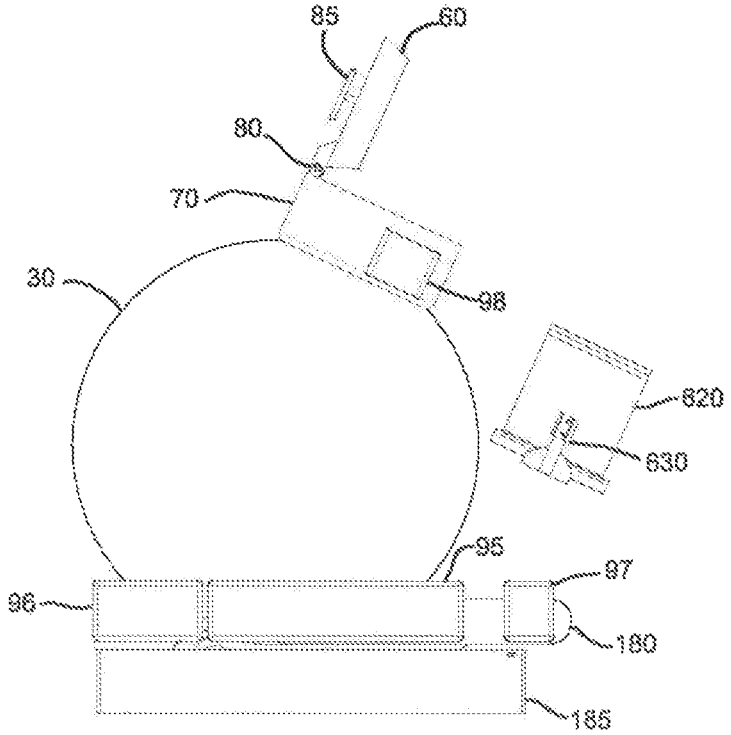
FIG. 54 is a port side view of components of an embodiment of an underwater craft in FIG. 52
Figure 55:
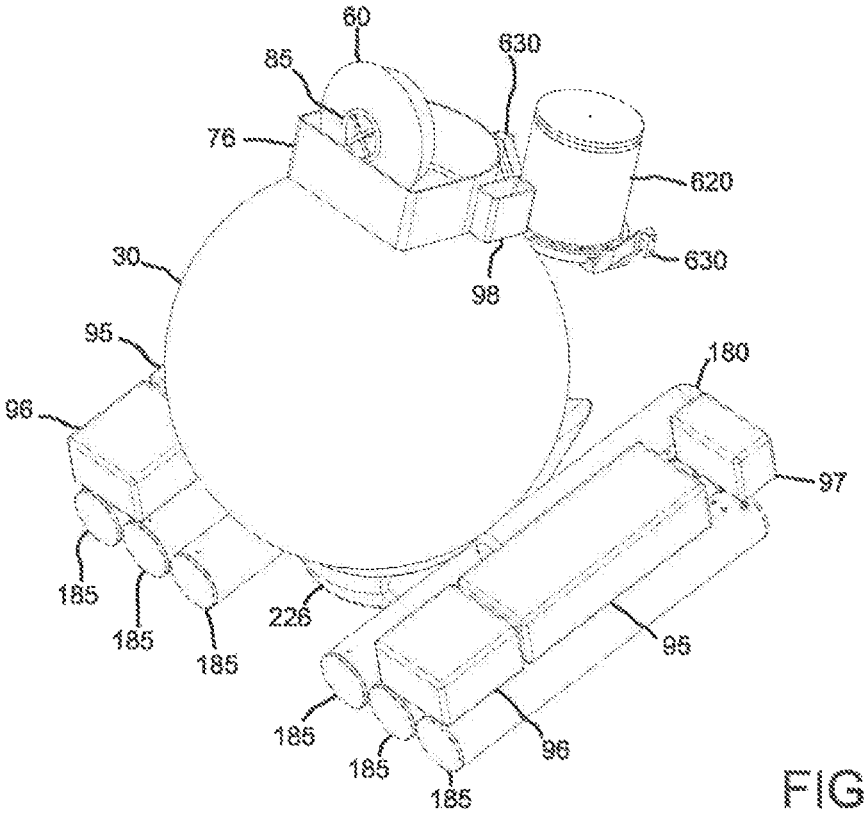
FIG. 55 is a front perspective view of components of an embodiment of an underwater craft in in accordance with the present invention.
Figure 56:
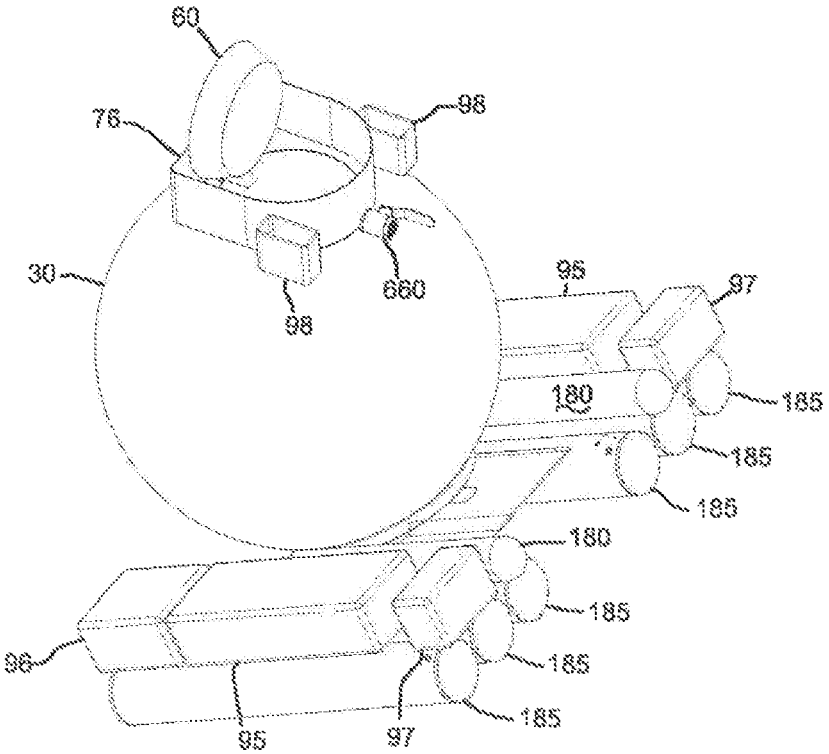
FIG. 56 is a rear perspective view of components of an embodiment of an underwater craft in in accordance with the present invention.

To help with ingress and egress, the entire passenger compartment 20, or part of it, may rotate to keep it at a desired angle with the water surface as the watercraft adopts a tail up attitude at surface. The passenger compartment may automatically or manually change its angle depending upon the attitude of the watercraft. This allows for a flat surface for the occupants to step on. An example of such embodiment is shown in FIG. 44. Alternatively the seat bases 384, or the entire seats 380 and 385, are adjustable such that they automatically or manually can change angle depending upon the attitude of the watercraft. An example of such an embodiment is shown in FIG. 45.

Thus, it is seen that an adjustable attitude underwater watercraft is provided. It should be understood that any of the foregoing configurations and specialized components may be interchangeably used with any of the apparatus or systems of the preceding embodiments. Although illustrative embodiments are described hereinabove, it will be evident to one skilled in the art that various changes and modifications may be made therein without departing from the scope of the disclosure. It is intended in the appended claims to cover all such changes and modifications that fall within the true spirit and scope of the disclosure.

The invention claimed is:

1. An underwater watercraft comprising:

a compartment defining an interior space;

an ingress/egress port positioned on the compartment, providing access to the interior space from outside the enclosed compartment; and an attitude adjustment system adapted to move the watercraft in at least two operational modes including:

a submerged mode defining a submerged mode center of gravity; and, a surface mode defining a surface mode center of gravity, the surface mode center of gravity being closer to the front of the watercraft in relation to the submerged mode center of gravity.

2. The underwater watercraft of claim 1 wherein:

the ingress/egress port defines an opening, having an opening plane; and in the surface mode of operation, the opening plane is substantially perpendicular to a direction of gravity.

3. The underwater watercraft of claim 1 further comprising an elongated hatch assembly, the direction of elongation of the hatch assembly being generally parallel to the direction of gravitational force at the surface attitude of the watercraft and angled in relation to the direction of gravitational force at the submerged attitude of the watercraft.

4. The underwater watercraft of claim 1 wherein the enclosed compartment includes a first portion and access pressure vessel attached to the first portion, the access pressure vessel defining an access pressure vessel interior space, the access pressure vessel interior space coextensive with the interior space of the first portion.

5. The underwater watercraft of claim 1 wherein the ingress/egress port includes a batch assembly, the hatch assembly including: openable hatch cover positioned on compartment and scaling the ingress/egress port in a closed position; and a riser extending from the compartment adjacent the openable hatch cover.

6. The underwater watercraft of claim 1 wherein the ingress/egress port, includes a hatch assembly, the hatch assembly including:

a hinged hatch cover spatially separated from the compartment;

a riser positioned between the compartment and the hatch cover;

a hinge assembly hingedly connecting the hatch cover to the riser.

7. The underwater watercraft of claim 6 wherein the riser is mounted at an angle relative to a surface plane in the surface mode.

8. The underwater watercraft of claim 6 wherein the riser is mounted parallel to a surface plane in the surface mode.

9. The underwater watercraft of claim 1 further comprising a tow point oriented such that in the surface mode a tow line is attachable to the tow point.

10. The underwater watercraft of claim 9 wherein the tow point is oriented to enable backward towing.

11. The underwater watercraft of claim 1, wherein the attitude adjustment system includes:

one or more surface ballast tank mounted above a horizontal midline of the compartment; and/or one or more bottom ballast tanks mounted below a horizontal midline of the compartment.

12. The underwater watercraft of claim 11 wherein the riser is mounted at an angle relative to a surface plane in the surface mode.

13. An underwater watercraft comprising:

a compartment defining an interior space;

an attitude adjustment system adapted to move the watercraft in at least two operational modes including:

a submerged mode defining a cruising orientation; and, a surface mode defining angled orientation in which the compartment is angled in relation to the plane perpendicular to the direction of gravity;

and an ingress/egress port assembly positioned on the compartment, providing access to the interior space from outside the enclosed compartment, the ingress/egress port assembly including a hatch at an angle in relation to a direction of gravity when the watercraft is in said surface mode.

14. The underwater watercraft of claim 13 further comprising a tow point oriented such that in the surface mode a tow line is attachable to the tow point.

15. The underwater watercraft of claim 14 wherein the tow point is oriented to enable backward towing.

16. The underwater watercraft of claim 13 further comprising:

a plurality of seats arranged within the compartment, the each of the plurality of seats including a seat base, the seat base angle being either in fixed orientation in relation to the compartment or mounted automatically or manually adjustable.

17. The underwater watercraft of claim 16 wherein at least one of the seats is movably mounted within the compartment and can be moved for viewing or boarding.

18. The underwater watercraft of claim 13 further comprising:

a housing positioned on the compartment;

a retractable handrail assembly positioned within the housing.

19. The underwater watercraft of claim 13, wherein the ingress/egress assembly further includes at least one step between the hatch and a seat positioned within the compartment.

20. The underwater watercraft of claim 13, wherein the ingress/egress assembly further includes a riser positioned between the compartment and the hatch.

* * * * *